US011071179B2

(12) United States Patent
Mu et al.

(10) Patent No.: US 11,071,179 B2
(45) Date of Patent: Jul. 20, 2021

(54) DIMMABLE LED DRIVE CIRCUIT AND CONTROL METHOD THEREOF

(71) Applicant: MAXIC TECHNOLOGY CORPORATION, Beijing (CN)

(72) Inventors: Zaixin Mu, Beijing (CN); Pan Zhang, Beijing (CN)

(73) Assignee: MAXIC TECHNOLOGY CORPORATION, Beijing (CN)

( * ) Notice: Subject to any disclaimer, the term of this patent is extended or adjusted under 35 U.S.C. 154(b) by 0 days.

(21) Appl. No.: 16/747,454

(22) Filed: Jan. 20, 2020

(65) Prior Publication Data

US 2020/0154541 A1 May 14, 2020

Related U.S. Application Data

(63) Continuation of application No. PCT/CN2019/090443, filed on Jun. 6, 2019.

(30) Foreign Application Priority Data

Jun. 8, 2018 (CN) ..... 201810590181.6
Jun. 15, 2018 (CN) ..... 201810623766.3
Jul. 23, 2018 (CN) ..... 201810812820.9

(51) Int. Cl.
*H05B 45/14* (2020.01)
*H05B 45/37* (2020.01)
(Continued)

(52) U.S. Cl.
CPC ..... *H05B 45/14* (2020.01); *H05B 45/345* (2020.01); *H05B 45/37* (2020.01); *H05B 45/40* (2020.01)

(58) Field of Classification Search
CPC ..... H05B 45/10; H05B 45/14; H05B 45/345; H05B 45/37; H05B 45/40; H05B 45/327; H05B 45/3575; H05B 45/3577
See application file for complete search history.

(56) References Cited

U.S. PATENT DOCUMENTS 9,559,675 B1 * 1/2017 Peng ..... H05B 45/3575
9,769,901 B1 * 9/2017 Vaughan ..... H05B 45/3575
(Continued)

FOREIGN PATENT DOCUMENTS

CN 105142260 A 12/2015
CN 106132030 A 11/2016
CN 208863094 U 5/2019

OTHER PUBLICATIONS

International Search Report in PCT/CN2019/090443 dated Sep. 9, 2019, 7 pages.

*Primary Examiner* — Amy Cohen Johnson
*Assistant Examiner* — Syed M Kaiser
(74) *Attorney, Agent, or Firm* — Metis IP LLC

(57) ABSTRACT

A dimmable LED drive circuit and a control method is provided in the present disclosure. The dimmable LED drive circuit may include a thyristor dimmer, a bleeder current circuit, and an LED circuit. The bleeder current circuit may provide a current required by the thyristor dimmer when an input voltage does not reach a forward voltage of the LED circuit. The dimmable LED drive circuit may further include a thyristor chopping angle detection circuit and a bleeder current control circuit. The thyristor chopping angle detection circuit may obtain a first electrical parameter signal characterizing a thyristor chopping angle when the thyristor dimmer is in a conducting state. The bleeder current control circuit may compare the first electrical parameter signal with a first threshold, and control the bleeder current circuit according to a comparison result. Moreover, an output current compensation circuit may also be included, which may be configured to compare the first electrical parameter signal with a second threshold to control a current flowing through the LED circuit.

18 Claims, 20 Drawing Sheets

(51) Int. Cl.
*H05B 45/345* (2020.01)
*H05B 45/40* (2020.01)

(56) References Cited

U.S. PATENT DOCUMENTS

| | | | | |
|---|---|---|---|---|
| 2011/0241557 | A1* | 10/2011 | Grotkowski | H05B 45/10 315/246 |
| 2012/0098454 | A1* | 4/2012 | Grotkowski | H05B 45/37 315/246 |
| 2013/0169177 | A1* | 7/2013 | Liao | H05B 47/10 315/200 R |
| 2014/0252975 | A1* | 9/2014 | Drakshapalli | H05B 45/37 315/210 |
| 2014/0265888 | A1 | 9/2014 | Ekbote | |
| 2014/0327371 | A1* | 11/2014 | Radermacher | H05B 45/37 315/210 |
| 2015/0130372 | A1* | 5/2015 | Chitta | H05B 45/50 315/307 |
| 2016/0218626 | A1* | 7/2016 | Del Carmen, Jr. | H05B 45/382 |
| 2016/0381753 | A1 | 12/2016 | Ma | |
| 2017/0027029 | A1* | 1/2017 | Hu | H05B 45/37 |
| 2017/0208659 | A1* | 7/2017 | Hau | H05B 45/50 |
| 2017/0280522 | A1* | 9/2017 | Chuang | H02M 1/081 |
| 2019/0208591 | A1 | 7/2019 | Chen et al. | |

* cited by examiner

DIMMABLE LED DRIVE CIRCUIT AND CONTROL METHOD THEREOF

CROSS-REFERENCE TO RELATED APPLICATIONS

This application claims priority to International Application No. PCT/CN2019/090443 filed on Jun. 6, 2019, which claims priority to Chinese Patent Application No. 201810590181.6 filed on Jun. 8, 2018, Chinese Patent Application No. 201810623766.3 filed on Jun. 15, 2018, and Chinese Patent Application No. 201810812820.9 filed on Jul. 23, 2018, the contents of which are incorporated herein by reference in their entirety.

TECHNICAL FIELD

The present disclosure relates to LED drive circuits, and more specifically, relates to a dimmable LED drive circuit and a control method thereof.

BACKGROUND

An LED driver usually operates in a linear manner, which has a simple structure, a small Electro-Magnetic Interference (EMI), and is compatible with most thyristor dimmers for dimming. However, when a linear LED is coupled with a thyristor dimmer, in order to maintain the conduction of a thyristor, the linear LED driver must be equipped with a bleeder current circuit. The bleeder current circuit needs to run in a specific time period to maintain a conducting state of the thyristor dimmer, which may undoubtedly increase the system loss, reduce the system efficiency, and is unable to improve the application power of the system.

In addition, a conduction angle chopping on a waveform of the input voltage may be performed by the thyristor dimmer to generate a chopped output voltage waveform. When the conduction angle of the thyristor dimmer is small, that is, a peak voltage of the output voltage after chopping is close to a forward voltage of a LED lamp, the chopping of the thyristor dimmer may be severely asymmetrical (e.g., the peak voltage after chopping is non-periodically larger or smaller than an output LED voltage), thus causing the flash of the LED lamp. As shown in FIG. 2, a $V_{LED}$ represents the forward voltage of the LED lamp. Due to the asymmetry of the chopping of the thyristor dimmer 10, the peak voltage after chopping in different time periods may fluctuate up and down around the $V_{LED}$ (e.g., in a first cycle, the peak voltage Vin_pk1 after chopping is larger than $V_{LED}$, and in a second cycle, the peak voltage after chopping Vin_pk2 is less than $V_{LED}$), thus resulting in a dramatic change of the current $I_{LED}$ of the LED lamp. When the frequency of the current change is less than a recognition frequency of human eyes, a flashing phenomenon visible to the human eyes may occur.

SUMMARY

In order to solve the aforementioned problems, a dimmable LED drive circuit and a control method thereof is provided in the present disclosure.

According to an aspect of the present disclosure, a dimmable LED drive circuit is provided. The dimmable LED drive circuit may include a thyristor dimmer, a bleeder current circuit, an LED circuit. The bleeder current circuit may provide a current required by the thyristor dimmer when an input voltage does not reach a forward voltage of the LED circuit. The dimmable LED drive circuit may further include a thyristor chopping angle detection circuit and a bleeder current control circuit. The thyristor chopping angle detection circuit may obtain a first electrical parameter signal characterizing a thyristor chopping angle after the thyristor dimmer is in a conducting state. The bleeder current control circuit may compare the first electrical parameter signal with a first threshold to control the bleeder current circuit.

In some embodiments, when detecting that the first electrical parameter signal is larger than the first threshold, the bleeder current control circuit may control the bleeder current circuit to turn off to stop providing a bleeder current.

In some embodiments, the bleeder current control circuit may compare a second electrical parameter signal characterizing a current flowing through the LED circuit with a third threshold. When the first electrical parameter signal is less than the first threshold and the second electrical parameter signal is less than the third threshold, the bleeder current control circuit may control the bleeder current circuit to turn on to provide a bleeder current.

In some embodiments, the first electrical parameter signal may correspond to an average value of the input voltage in one cycle from an initial conduction chopping angle of the thyristor dimmer to the end of the cycle.

In some embodiments, the thyristor chopping angle detection circuit may include an integral circuit configured to perform an integral of an input voltage to provide the first electrical parameter signal.

In some embodiments, the first electrical parameter signal may correspond to an average value of reference voltages in a sampling period of a second electrical parameter signal. The second electrical parameter signal may characterize a current flowing through the LED circuit.

In some embodiments, the thyristor chopping angle detection circuit may include a first operational amplifier U1 and a sampling integral circuit. A non-inverting input terminal of the first operational amplifier U1 may receive the second electrical parameter signal. An inverting input terminal of the first operational amplifier U1 may receive a fifth threshold. An output terminal of the first operational amplifier U1 may be connected to the sampling integral circuit. The sampling integral circuit may receive a reference voltage. An output terminal of the sampling integral circuit may be connected to the bleeder current control circuit for inputting the first electrical parameter signal into the bleeder current control circuit after an operation processing.

In some embodiments, the first electrical parameter signal may correspond to an average value of the reference voltages within a sampling cycle starting with a rising edge of the input voltage and ending with a falling edge of the second electrical parameter signal. The second electrical parameter signal may characterize a current flowing through the LED circuit.

In some embodiments, the thyristor chopping angle detection circuit may include a second operational amplifier U2, a third operational amplifier U3, a first pulse generation circuit A1, a second pulse generation circuit A2, an RS trigger, and a sampling integral circuit. A non-inverting input terminal of the second operational amplifier U2 may receive an input voltage sampling signal. An inverting input terminal of the second operational amplifier U2 may receive a sixth threshold for providing a starting threshold of a rising edge acquisition. An inverting input of the third operational amplifier U3 may receive the second electrical parameter signal. A non-inverting input terminal of the third operational amplifier U3 may receive a seventh threshold for providing an end threshold of a falling edge acquisition.

Output terminals of the second operational amplifier U2 and the third operational amplifier U3 may be connected to input terminals of the first pulse generation circuit A1 and the second pulse generation circuit A2, respectively. Output terminals of the first pulse generation circuit A1 and the second pulse generation circuit A2 may be connected to an S terminal and an R terminal of the RS trigger, respectively. A pulse signal may be input to the RS trigger by a pulse circuit when detecting a flip signal generated by an operational amplifier. An output terminal of the RS trigger may be connected to the sampling integral circuit. The sampling integral circuit may receive the reference voltage. An output terminal of the sampling integral circuit may be connected to the bleeder current control circuit for inputting the first electrical parameter signal into the bleeder current control circuit after an operation processing.

In some embodiments, the dimmable LED drive circuit may further include an output current compensation circuit configured to compare the first electrical parameter signal with a second threshold to control a current flowing through the LED circuit. The second threshold may be less than the first threshold and may indicate that a peak voltage of the input voltage after chopping of the thyristor dimmer is close to forward voltage of the LED circuit.

In some embodiments, the output current compensation circuit may include a first transconductance amplifier configured to limit an output current of the output current compensation circuit to reduce a peak current of a current flowing through the LED circuit when the first electrical parameter signal is less than the second threshold.

In some embodiments, the output current compensation circuit may further include a second transconductance amplifier configured to limit an output current of the first transconductance amplifier when the first electrical parameter signal is less than a fourth threshold. The second threshold may be larger than the fourth threshold.

In some embodiments, the bleeder current control circuit may include a first comparison amplifier configured to compare the first threshold with the first electrical parameter signal, and a second comparison amplifier configured to compare the third threshold with the second electrical parameter signal.

In some embodiments, the bleeder current circuit may include a current source and a switch. The current source and the switch circuit may be connected in series. The switch circuit may switch on or switch off under a control of the bleeder current control circuit.

In some embodiments, the first threshold, the second threshold, the third threshold, and the fourth threshold may be any of a current threshold, a voltage threshold, and a time threshold.

According to another aspect of the present disclosure, a control method is provided. The method may include obtaining a first electrical parameter signal characterizing a thyristor chopping angle when a thyristor dimmer is conducted. The method may further include providing, using a bleeder current circuit, a current required by the thyristor dimmer when an input voltage does not reach a forward voltage of an LED circuit. The input voltage may be a full-wave rectified voltage obtained by a rectifier bridge rectifying an alternating current flowing through the thyristor dimmer, and may be used as a driving voltage of the LED circuit. The method may also include comparing, using a bleeder current control circuit, the first electrical parameter signal with a first threshold, and controlling the bleeder current circuit according to a comparison result.

In some embodiments, the method may further include turning off a bleeder current using the bleeder current circuit when the first electrical parameter signal is larger than the first threshold.

In some embodiments, the method may further include detecting whether the first electrical parameter signal is less than a second threshold when the first electrical parameter signal (Vout) is less than the first threshold. The second threshold may be less than the first threshold and may indicate that a peak voltage of the input voltage after chopping of the thyristor dimmer is close to forward voltage of the LED circuit. The method may further include maintaining a peak current flowing through the LED circuit unchanged when the first electrical parameter signal is larger than the second threshold. The method may also include reducing the peak current flowing through the LED circuit when the first electrical parameter signal is less than the second threshold.

In some embodiments, the method may further include detecting a second electrical parameter and determining whether the second electrical parameter is less than a third threshold by the bleeder current control circuit. The second electrical parameter may characterize a current flowing through the LED circuit. The method may further include providing, by the bleeder current circuit, a bleeder current when the second electrical parameter is less than the third threshold. The method may also include stopping providing, by the bleeder current circuit, the bleeder current when the second electrical parameter is larger than the third threshold.

In some embodiments, the first electrical parameter signal may correspond to an average value of the input voltage in one cycle from an initial conduction chopping angle of the thyristor dimmer to the end of the cycle.

In the present disclosure, efficiency and stability of the linear thyristor LED drive circuit may be improved by controlling the turn-on and turn-off of the bleeder current. At the same time, the problem of small-angle flash problem of the thyristor dimmer may be solved.

DETAILED DESCRIPTION

In order to clarify the technical solutions and advantages in the embodiments of the present disclosure, the technical solutions of the present disclosure will be further described in detail below through the accompanying drawings and embodiments.

Figure 1:
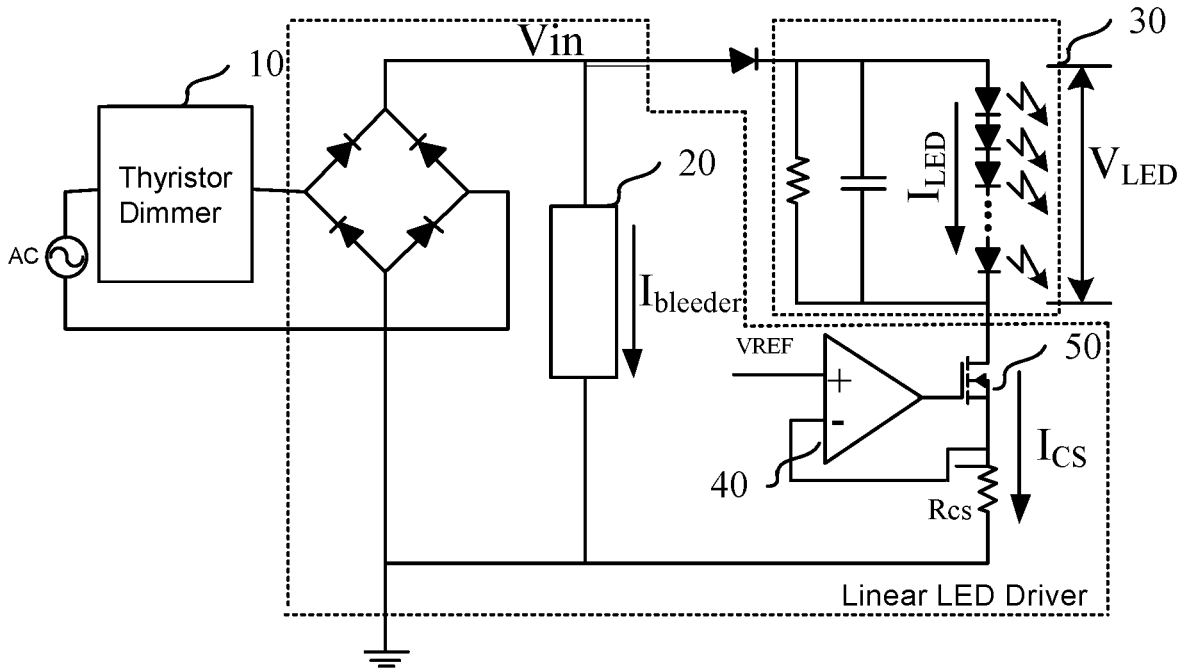
FIG. 1 is a schematic diagram illustrating an exemplary dimmable LED drive circuit in a prior art.
Figure 2:
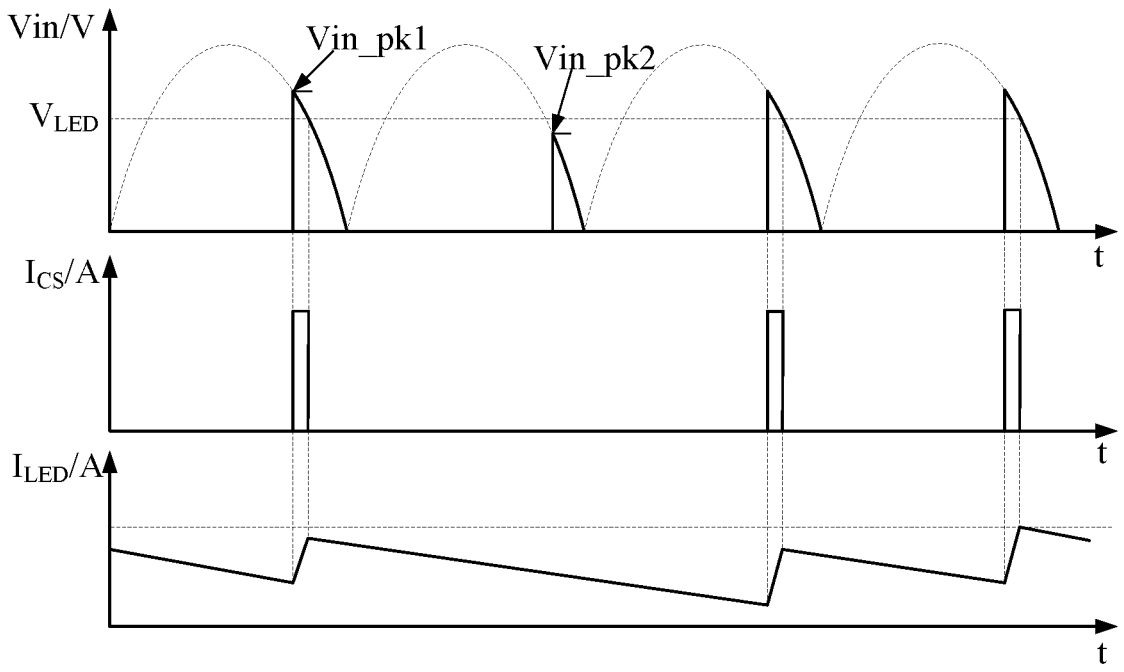
FIG. 2 is a schematic diagram illustrating exemplary waveforms of an $I_{CS}$ current and an LED current when a conduction angle of a thyristor dimmer of the dimmable LED drive circuit is small in the prior art.

FIG. 1 illustrates a dimmable LED drive circuit, including an AC power source, a thyristor dimmer 10, a rectifier bridge, a bleeder current circuit 20, an LED circuit 30, a power control circuit 40, a MOS transistor 50, and a sampling resistor $R_{CS}$. In the dimmable LED drive circuit, the thyristor dimmer 10 may be connected to an input terminal of the rectifier bridge in series and powered by the AC power source. One output terminal of the rectifier bridge may be grounded, and another output terminal of the rectifier bridge may be configured to provide an input voltage Vin. The another output terminal of the rectifier bridge may provide a full-wave rectified voltage as the input voltage Vin, which acts as a driving voltage for driving the LED circuit.

The LED circuit 30, the MOS transistor 50 and the sampling resistor $R_{CS}$ may be connected in series. Another terminal of the LED circuit 30 may be configured to receive the input voltage Vin, and another terminal of the sampling resistor $R_{CS}$ may be grounded. One terminal of the bleeder current circuit 20 may be configured to receive the input voltage Vin, and another terminal of the bleeder current circuit 20 may be grounded. A first input terminal of the power control circuit 40 may be configured to receive a reference voltage $V_{REF}$, a second input terminal of the power control circuit 40 may be positioned between the MOS transistor 50 and the resistor $R_{CS}$, and an output terminal of the power control circuit 40 may be connected to a gate of the MOS transistor 50. In some embodiments, the LED circuit 30 may include LED lamps connected in series and a resistor-capacitor circuit connected in parallel with the LED lamps.

Figure 3:
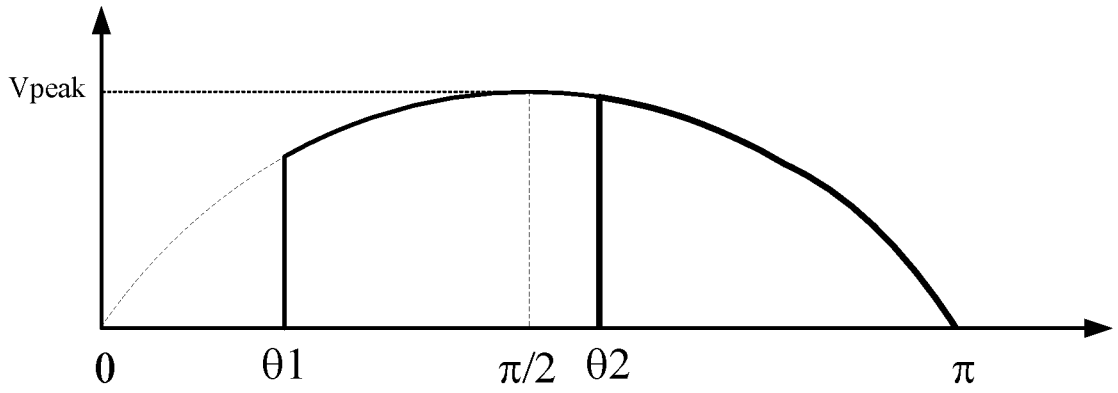
FIG. 3 is a schematic diagram illustrating an exemplary relationship between a rectified input voltage Vin and a conduction chopping angle of the thyristor dimmer in one cycle according to some embodiments of the present disclosure.

In some embodiments, a chopping of the thyristor dimmer 10 may be characterized by angles. FIG. 3 illustrates one cycle of an input voltage Vin chopped by the thyristor dimmer 10. θ1 is the minimum initial conduction chopping angle. A conduction chopping may occur at any angle between θ1 and π. θ2 is an example of an initial conduction chopping angle of the thyristor dimmer, where θ1 may be smaller than θ2. π to θ1 and π to θ2 may be conduction widths of the thyristor dimmer at the angle θ1 and the angle θ2, respectively. The maximum value Vpeak of the input voltage Vin may appear at the angle π/2.

Figure 4:
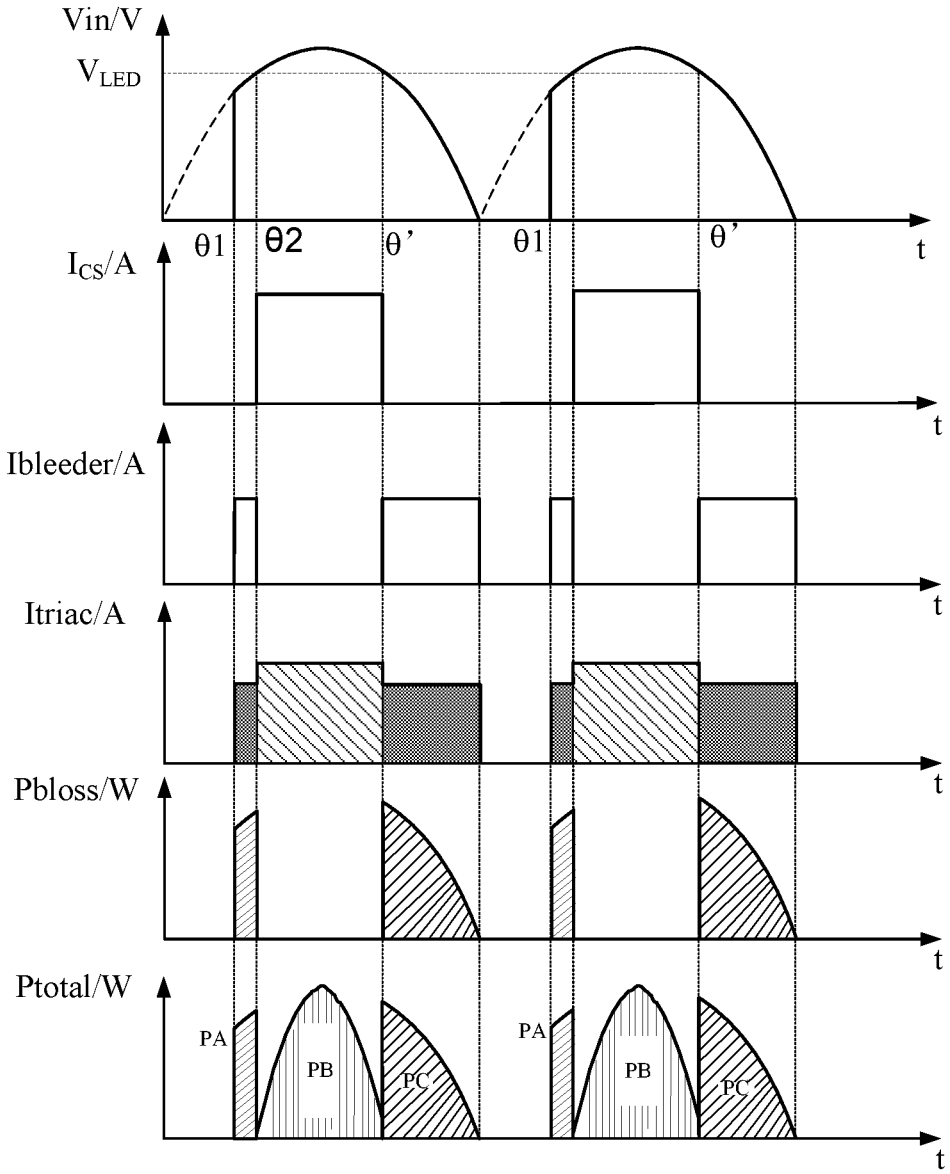
FIG. 4 is a schematic diagram illustrating exemplary power losses caused by a bleeder current of the dimmable LED drive circuit in the prior art.

When the thyristor dimmer 10 is in the conducting state (e.g., at any angle between θ1 to π in FIG. 4), a certain current may be required to maintain the conduction (e.g., an $I_{triac}$ in FIG. 4 indicates a current conduction in the thyristor dimmer). Before the input voltage Vin reaches a forward voltage $V_{LED}$ of the LED circuit 30 (e.g., between θ1 and θ2 in FIG. 4), the LED circuit 30 may be in the non-conducting state. A bleeder current circuit 20 may be added to provide a current (i.e., an $I_{bleeder}$ is not 0 at this time) so as to keep the thyristor dimmer 10 in the conducting state. After the input voltage Vin reaches the forward voltage of the LED circuit 30 (e.g., between θ2 and θ' in FIG. 4), the LED circuit 30 may be conducted and the circuit may generate a current, at which point the current required by the thyristor dimmer 10 may be replaced by the current (i.e., $I_{CS}$ in FIG. 4) of the LED circuit 30. Additionally, when the input voltage Vin is less than the forward voltage of the LED circuit 30 (e.g., an interval after θ' to the end of a cycle in FIG. 4), the LED circuit 30 may be in the non-conducting state again, and the thyristor dimmer 10 may still need a current (i.e., (bleeder is not 0 at this time) supplied by the bleeder current circuit 20. Since the bleeder current generated by the bleeder current circuit 20 is not a load current, a large amount of losses may be caused. FIG. 4 illustrates exemplary circuit losses. As shown in FIG. 4, a total loss of the circuit in one cycle may be Ptotal=PA+PB+PC, where PA and PC are power losses (corresponding to Pbloss in FIG. 4) caused by the bleeder current, and PB is an inherent power loss in a linear LED driver, that is, a loss caused by a difference between an input voltage and an LED voltage. Compared with the power loss PA in a stage starting from the conduction of the thyristor dimmer 10 until the input voltage Vin is larger than the forward voltage of the LED circuit 30, the power loss PC in a stage starting from a point when the input voltage Vin is less than the forward voltage of the LED circuit 30 is greater. In some embodiments, it is possible to reduce the power consumption of the circuit by reducing the power losses of the bleeder current in the PC stage (e.g., turning off or reducing the bleeder current in the PC stage).

Figure 5:
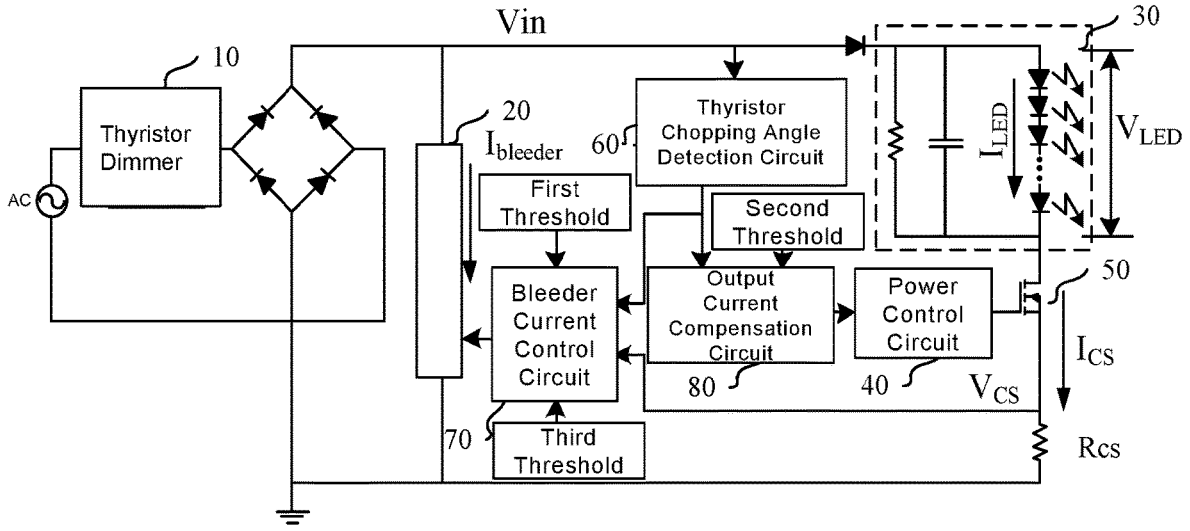
FIG. 5 is a schematic diagram illustrating an exemplary dimmable LED drive circuit according to some embodiments of the present disclosure.

FIG. 5 is a schematic diagram illustrating an exemplary dimmable LED drive circuit according to some embodiments of the present disclosure. As shown in FIG. 5, in a dimmable LED drive circuit, a thyristor chopping angle detection circuit 60 and a bleeder current control circuit 70 may be included. An input terminal of the thyristor chopping angle detection circuit 60 may be configured to receive the input voltage Vin, and an output terminal of the thyristor chopping angle detection circuit 60 may be connected to a first input terminal of the bleeder current control circuit 70. A second input terminal of the bleeder current control circuit 70 may be positioned between a drain of the MOS transistor 50 and the resistor $R_{CS}$, and an output terminal of the bleeder current control circuit 70 may be connected to the bleeder current circuit 20.

When the thyristor dimmer 10 is in the conducting state, an AC power source voltage Vac may be chopped by the thyristor dimmer 10 and further supplied to the thyristor chopping angle detection circuit 60 in the form of full-wave rectified voltage. In some embodiments, the thyristor chopping angle detection circuit 60 may detect an initial conduction chopping angle θ of the thyristor dimmer 10. The bleeder current control circuit 70 may control an operating state of the bleeder current circuit 20 based on the detected initial conduction chopping angle θ. Specifically, an electrical parameter signal Vout corresponding to the initial conduction chopping angle θ may be detected by the thyristor chopping angle detection circuit 60, which may be further sent to the bleeder current control circuit 70.

The thyristor chopping angle may be characterized by the electrical parameter signal Vout. For example, the electrical parameter signal Vout may be expressed as an average value of the input voltage Vin in one cycle from the initial conduction chopping angle of the thyristor dimmer (10) to the end of the cycle. In one cycle, the larger the initial conduction chopping angle θ is, the smaller the corresponding electrical parameter signal Vout may be.

Before the LED circuit 30 is in the conducting state, the bleeder current control circuit 70 may compare the electrical parameter signal Vout with a first threshold according to a first (voltage) threshold set therein after the electrical parameter signal Vout output by the thyristor chopping angle detection circuit 60 is received. The first threshold may also correspond to an initial chopping angle threshold (also referred to as a first angle threshold). When the electrical parameter signal Vout is less than the first threshold (i.e., the initial conduction chopping angle θ is larger than the first angle threshold), the bleeder current control circuit 70 may conduct the bleeder current circuit 20 to provide a bleeder current. When the electrical parameter signal Vout is larger than the first threshold (i.e., the initial chopping angle θ is less than the first angle threshold), the bleeder current control circuit 70 may turn off the bleeder current circuit 20 to stop providing the bleeder current to reduce the power consumption.

Preferably, when the electrical parameter signal Vout is larger than the first threshold, the bleeder current may be turned off first, and then the bleeder current circuit 20 may be turned on after a certain time (e.g., 1 ms). More preferably, the bleeder current circuit 20 that is turned on again may provide a small bleeder current. The small bleeder current herein may be referred relative to the bleeder current before the turn-off operation. A magnitude of the small bleeder current may be proportional to a magnitude of the bleeder current before the turn-off operation. The ratio between the magnitudes may be 0.1, 0.2, 0.5, or any other value between 0 and 1.

Preferably, when the electrical parameter signal Vout is larger than the first threshold, the bleeder current circuit 20 may directly provide a smaller bleeder current.

Figure 6:
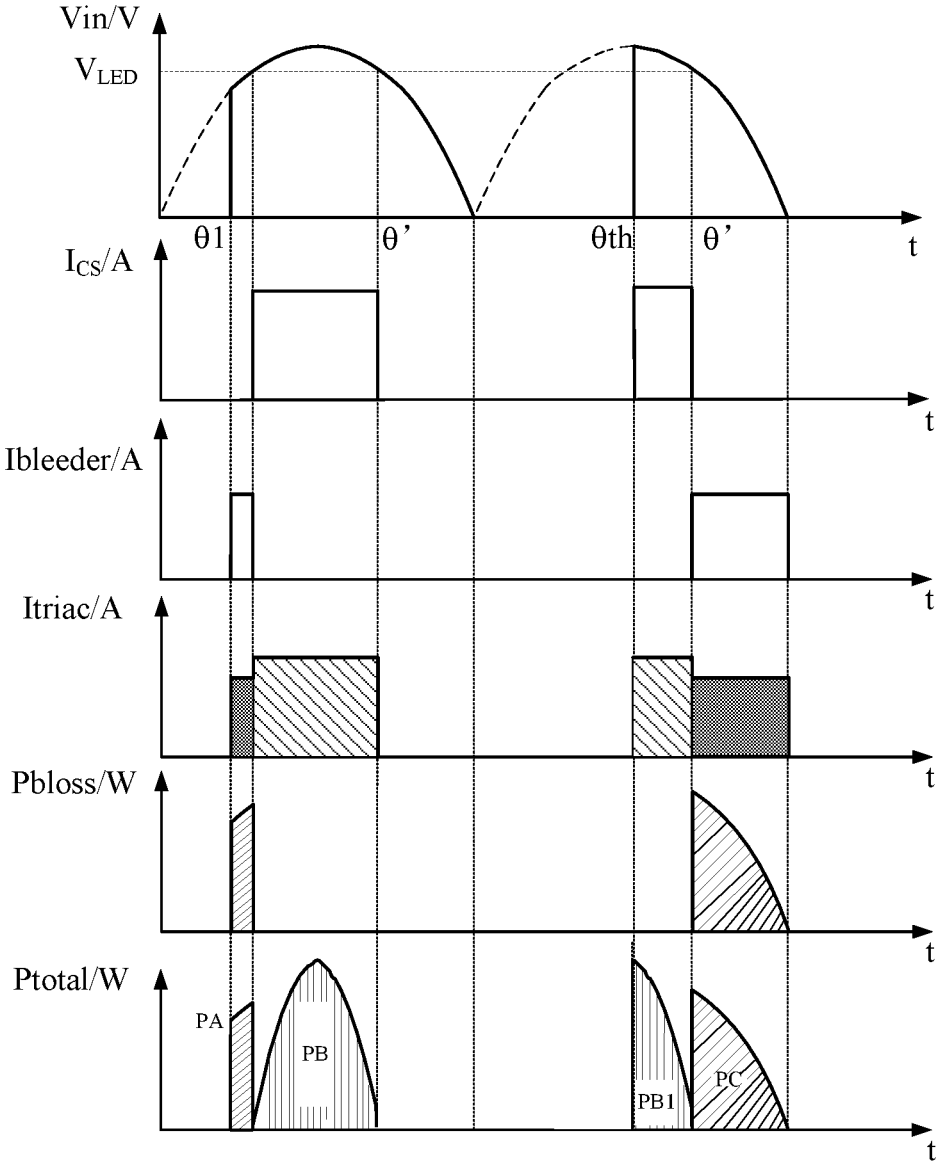
FIG. 6 is a schematic diagram illustrating exemplary power losses when a bleeder current circuit is turned on or off according to some embodiments of the present disclosure.

FIG. 6 is a schematic diagram illustrating exemplary power losses when a bleeder current circuit is turned on or off. FIG. 6 illustrates two half-waves of Vin, in which the left half-wave may correspond to a power loss of the thyristor dimmer 10 at a maximum conduction width, and the power loss may be PA+PB. The right half-wave may correspond to a power loss of the thyristor dimmer 10 at any conduction width, and the power loss may be PB1+PC.

The first threshold may be set by a user according to a specific rule. For example, the first threshold may be related to power losses of the dimmable LED drive circuit at different time periods. In particular, the first threshold set in the bleeder current control circuit 70 may cause the dimmable LED drive circuit to substantially satisfy equation (1):

$$PA+PB \geq PB1+PC \quad (1)$$

If PB1 is large and the Equation (1) is not satisfied, the bleeder current circuit 20 may be turned off, or a current loss thereof may be reduced.

Merely by way of example, the first threshold value may correspond to an average value of the input voltage Vin during a period from a first initial conduction chopping angle to the end of a cycle in which the thyristor dimmer 10 has the first initial conduction chopping angle. A sum of a power loss (PA) of the linear LED drive and a circuit loss (PB) of the bleeder current circuit 20 without adjusting an output current in the cycle in which the thyristor dimmer 10 has the first initial chopping angle may be equivalent to a sum of a power loss (PB1) of the linear LED drive and a circuit loss (PC) of the bleeder current circuit before the input voltage Vin reaches the forward voltage of the LED circuit 30 in a cycle with a minimum initial chopping angle. That is to say, the first threshold set at this time may be a critical value. If the average value corresponding to the first threshold is larger than the critical value, the power consumption of the circuit may not be reduced.

Figure 7:
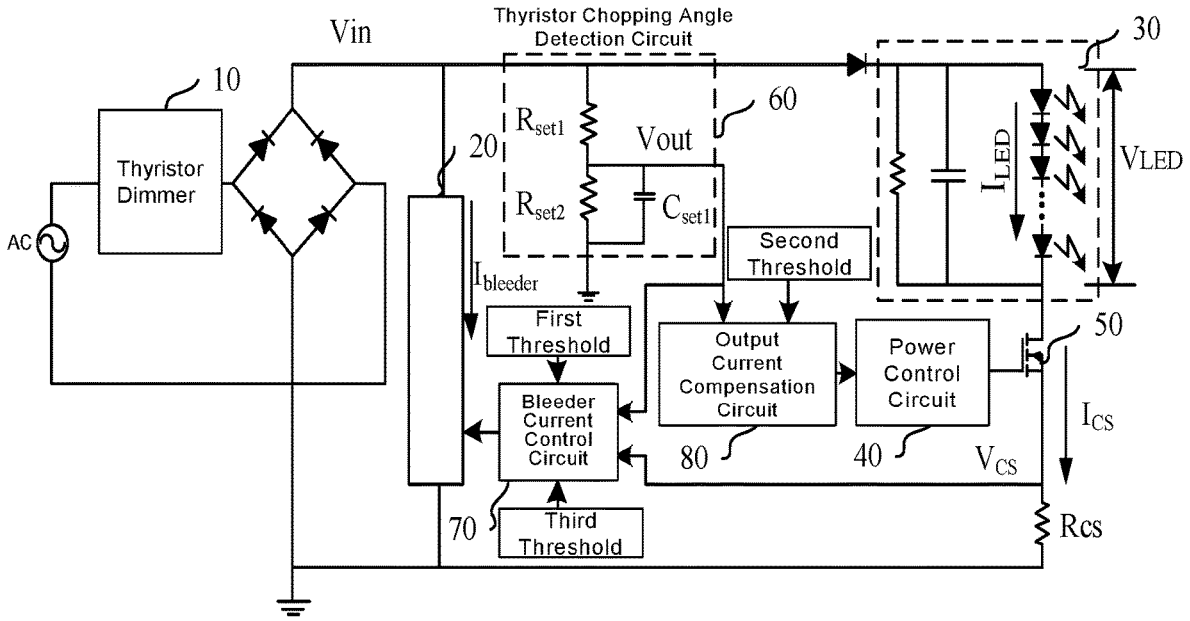
FIG. 7 is a schematic diagram illustrating an exemplary thyristor chopping angle detection circuit according to some embodiments of the present disclosure.

In some embodiment, as shown in FIG. 7, the thyristor chopping angle detection circuit 60 may include an integral circuit. Merely by way of example, the integral circuit may include a resistor Rset1, a resistor Rset2, and a capacitor Cset1. The resistor Rset1 and the resistor Rset2 may form a voltage dividing circuit connected between the Vin and the ground, the capacitor Cset1 and the resistor Rset2 may be connected in parallel. In the circuit illustrated in FIG. 7, a Vin may be divided by the resistors Rset1 and the Rset2 to generate a voltage which may be processed by the bleed control circuit. Further, the voltage may be integrated by the capacitor Cset1 to generate a Vout, which is a scaling-down average value of the input voltage Vin from the initial chopping angle of the thyristor dimmer 10 to the end of the cycle.

Optionally, in the thyristor chopping angle detection circuit 60, a resistor Rset3 may be added between an intermediate node of the resistor Rset1 and the resistor Rset2, so as to make the ripple of the electrical parameter signal Vout better.

When the input voltage Vin is input to the thyristor chopping angle detection circuit 60, the thyristor chopping angle detection circuit 60 may detect a chopping angle of the thyristor dimmer 10 by means of a series-parallel connection of resistors and a capacitor, such that the initial conduction chopping angle θ of the thyristor dimmer 10 may be converted into the specific electrical parameter signal Vout. An initial voltage value of the thyristor dimmer 10 may be flexibly set by adjusting a resistance ratio of the resistor Rset1 and the resistor Rset2, and the larger the capacitance of the capacitor Cset1 is, the smaller the ripple of the electrical parameter signal Vout may be. In a case where the resistance(s) (or capacitance) of the resistor(s) (or capacitor) is determined, the voltage of the electrical parameter signal Vout may gradually decrease as the initial chopping angle θ of the thyristor dimmer 10 increases, which may be expressed according to equation (2):

$$Vout = \frac{1}{\pi} Vpeak(\cos\theta + 1) \times \frac{R_{set2}}{R_{set1} + R_{set2}} \quad (2)$$

where an alternating voltage Vac=Vpeak·sin θ, Vpeak represents a maximum voltage of the AC power source, and θ represents an initial conduction chopping angle of the input voltage of the thyristor dimmer 10.

Preferably, supposing that the first threshold is a voltage threshold VREF1, an initial conduction angle threshold θth (i.e., the first angle threshold) of the thyristor dimmer 10 may be obtained according to an inverse of equation (2):

$$\theta th = \arccos\left(\frac{\pi \times VREF1}{Vpeak} \times \frac{(R_{set1} + R_{set2})}{R_{set2}} - 1\right) \quad (3)$$

According to equation (3), the conduction angle threshold θth of the thyristor dimmer 10 may be determined according to the first threshold. When the initial conduction angle θ of the thyristor dimmer 10 is less than θth, the conduction of the bleeder current circuit 20 may be turned off by the bleeder current control circuit 70 to stop providing the bleeder current. When the initial conduction angle θ of the thyristor dimmer 10 is larger than θth, the conduction of the bleeder current circuit 20 may be turned on by the bleeder current control circuit 70 to provide a bleeder current.

Optionally, the bleeder current may be a variable current. When the initial conduction angle θ of the thyristor dimmer 10 is less than θth, the bleeder current circuit 20 may stop providing the bleeder current. Then, a smaller bleeder current may be provided after a certain delay time.

Optionally, the bleeder current may be a variable current. When the initial conduction angle θ of the thyristor dimmer 10 is less than θth, the bleeder current circuit 20 may provide a smaller bleeder current to discharge a busbar after the thyristor dimmer 10 is turned off.

In some embodiments for controlling the bleeder current, if the electrical parameter signal Vout received by the bleeder current control circuit 70 is larger than the first threshold, the bleeder current circuit 20 may be turned off so as to stop providing the bleeder current. At this time, since the LED circuit 30 is conducted, a voltage $V_{CS}$ of the sampling resistor $R_{CS}$ may be received by the bleeder current control circuit 70, which may characterize a current flowing through the LED circuit 30. The voltage $V_{CS}$ may be hereinafter referred to as an electrical parameter signal $V_{CS}$. Furthermore, the electrical parameter signal $V_{CS}$ may be compared with an internally set third threshold. When the electrical parameter signal Vout is less than the first threshold and the voltage $V_{CS}$ is less than the third threshold, the bleeder current control circuit 70 may control the bleeder current circuit 20 to turn on to provide a bleeder current.

Figure 14:
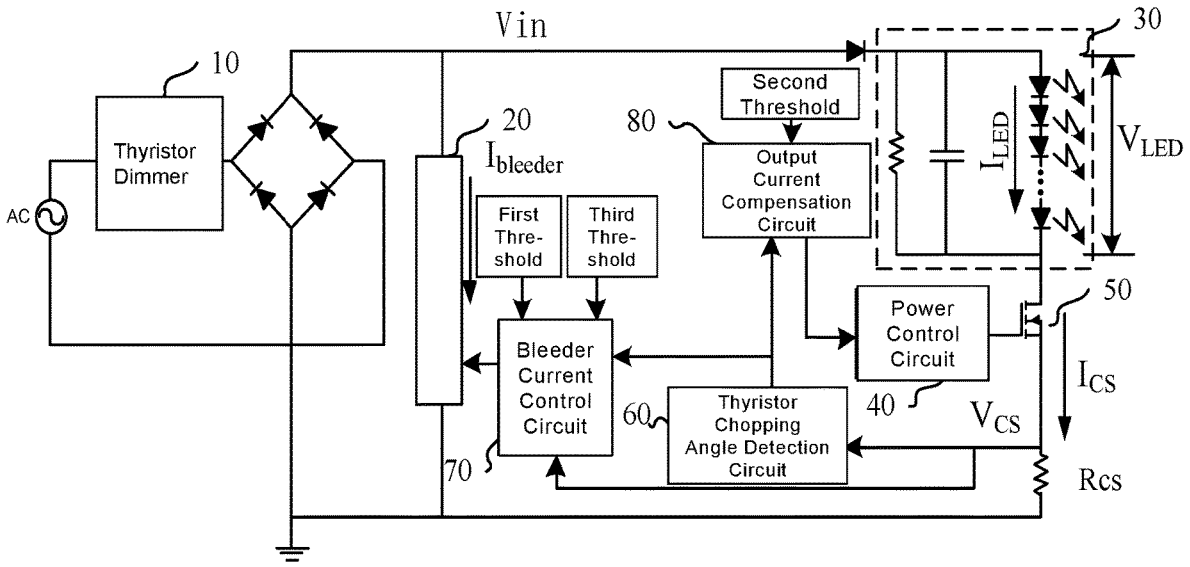
FIG. 14 is a schematic diagram illustrating another exemplary dimmable LED drive circuit according to some embodiments of the present disclosure.

As shown in FIG. 14, embodiments of the thyristor chopping angle detection circuit 60 are not limited to obtain an electrical parameter signal Vout characterizing the thyristor chopping angle parameter by detecting the input voltage Vin. Embodiments in which the electrical parameter signal Vout is obtained by detecting the electrical parameter signal $V_{CS}$ may also be included. For better understanding, the electrical parameter signal $V_{CS}$ and the electrical parameter signal Vout may be named as a first electrical parameter signal Vout and a second electrical parameter signal $V_{CS}$, respectively. As shown in FIG. 14, an input terminal of the thyristor chopping angle detection circuit 60 may be connected to a common terminal between a source of the MOS transistor 50 and the resistor $R_{CS}$. An output terminal of the thyristor chopping angle detection circuit 60 may be connected to an output current compensation circuit 80 and the bleeder current control circuit 70, respectively. The first electrical parameter signal Vout may correspond to an average value of the reference voltage in a sampling cycle of the second electrical parameter signal $V_{CS}$. The second electrical parameter signal $V_{CS}$ may characterize a current flowing through the LED circuit 30.

Figure 15:
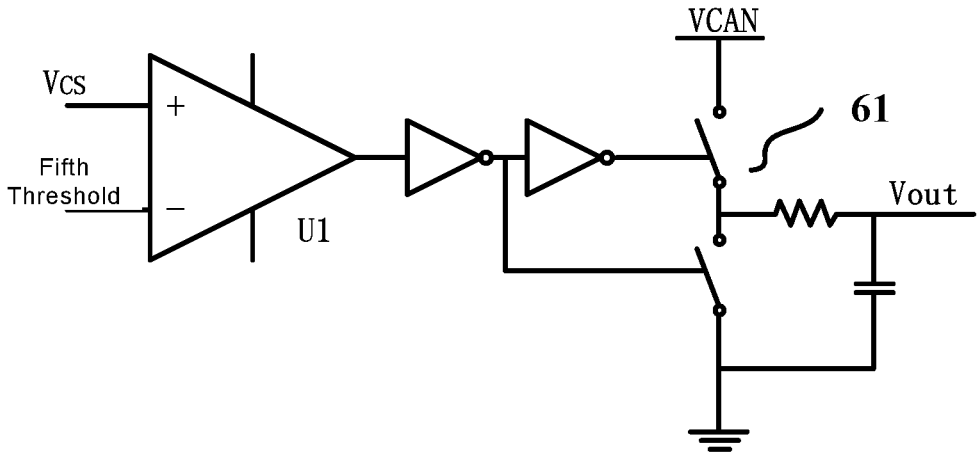
FIG. 15 is a schematic diagram illustrating an exemplary circuit for detecting a second electrical parameter signal according to some embodiments of the present disclosure.

FIG. 15 is a schematic diagram illustrating an exemplary circuit for detecting a second electrical parameter signal. As shown in FIG. 15, the thyristor chopping angle detection circuit 60 may include a first operational amplifier U1 and a sampling integral circuit 61. A non-inverting input terminal of the first operational amplifier U1 may be configured to receive the second electrical parameter signal $V_{CS}$. An inverting input terminal of the first operational amplifier U1 may be configured to receive a fifth threshold. The second electrical parameter signal $V_{CS}$ that is larger than the fifth threshold may be sampled by the thyristor chopping angle detection circuit 60. An output terminal of the first operational amplifier U1 may be connected to the sampling integral circuit 61. The sampling integral circuit 61 may be provided with the reference voltage. An output terminal of the sampling integral circuit 61 may be connected to the bleeder current control circuit 70 for inputting the first current parameter signal Vout after an operation processing. Preferably, two NOT gates connected in series may be further arranged between the output terminal of the first operational amplifier U1 and an input terminal of the sampling integral circuit 61. A common terminal between the two NOT gates may be connected to a control terminal of a switch in the sampling integral circuit 61. An output terminal of the NOT gates connected to the sampling integral circuit 61 may be connected to a control terminal of another switch in the sampling integral circuit 61. One terminal of the two switches arranged in series may be provided with the reference voltage, and the other terminal may be grounded. A common terminal of the two switches may be connected to an integral resistor. An integral capacitor may be provided between the integral resistor and the ground. A charge time and a discharge time of the sampling integral circuit 61 may be controlled by the first operational amplifier U1 according to a comparison result between the second electrical parameter signal $V_{CS}$ and the fifth threshold, so as to obtain the first electrical parameter signal Vout characterizing the thyristor chopping angle. By detecting the electrical parameter signal $V_{CS}$ to obtain the electrical parameter signal Vout, the detection accuracy may be improved, and the sampling process may be simpler and more reliable.

Figure 16:
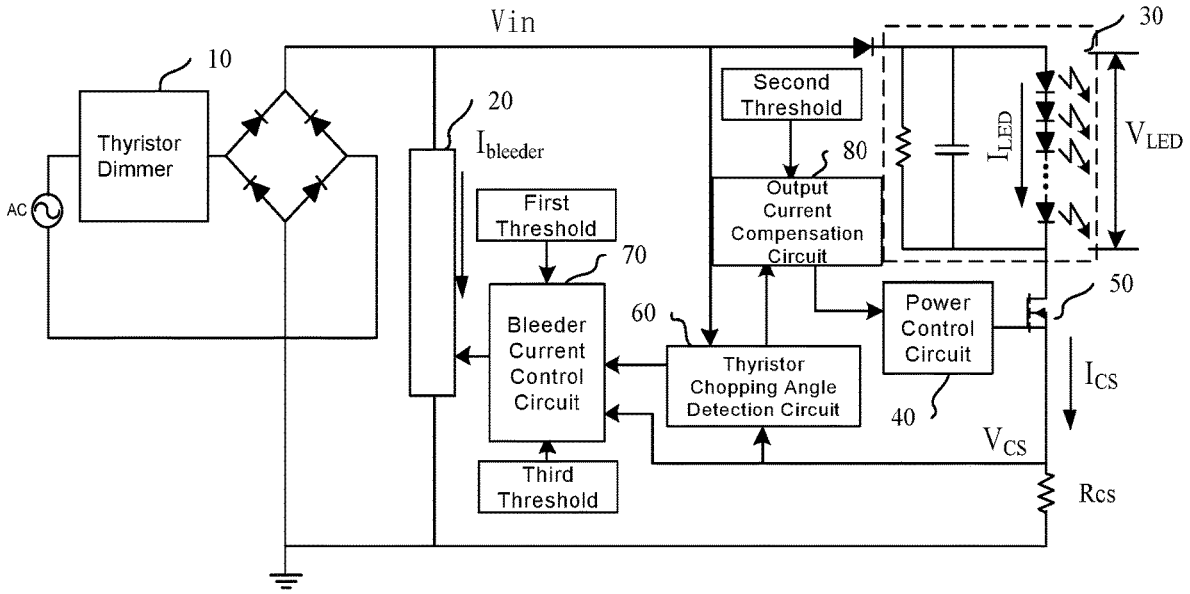
FIG. 16 is a schematic diagram illustrating another exemplary dimmable LED drive circuit according to some embodiments of the present disclosure.

As shown in FIG. 16, in some embodiments, the thyristor chopping angle detection circuit 60 may also obtain an electrical parameter signal Vout by simultaneously detecting the input voltage Vin and the second electrical parameter signal $V_{CS}$. As shown in FIG. 16, the input terminal of the thyristor chopping angle detection circuit 60 may be connected not only to the common terminal between the source of the MOS transistor 50 and the resistor $R_{CS}$, but also to a voltage bus of the LED drive circuit for collecting the input voltage Vin. The first electrical parameter signal Vout may correspond to an average value of the reference voltage within a sampling cycle starting with a rising edge of the input voltage Vin and ending with a falling edge of the second electrical parameter signal $V_{CS}$.

Figure 17:
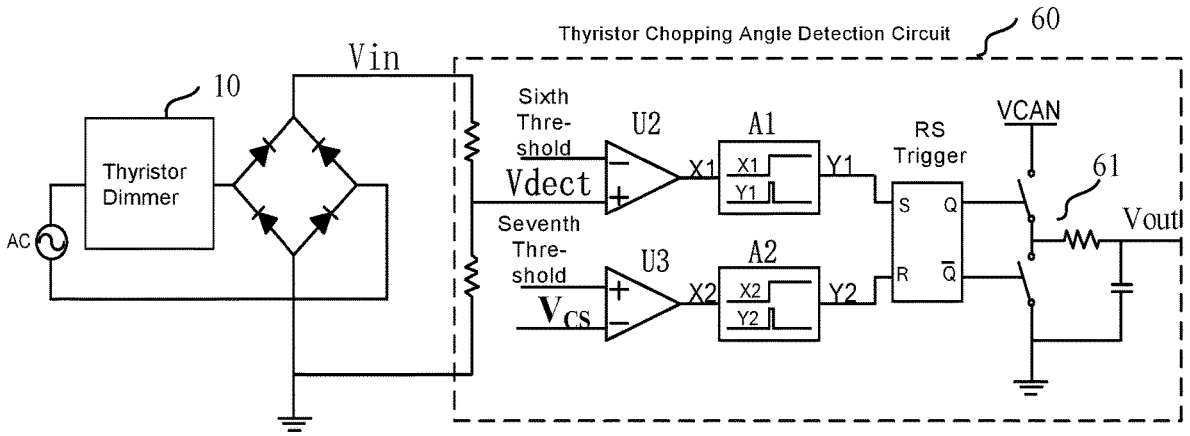
FIG. 17 is a schematic diagram illustrating an exemplary circuit for detecting an input voltage and a second electrical parameter signal according to some embodiments of the present disclosure.
Figure 18:
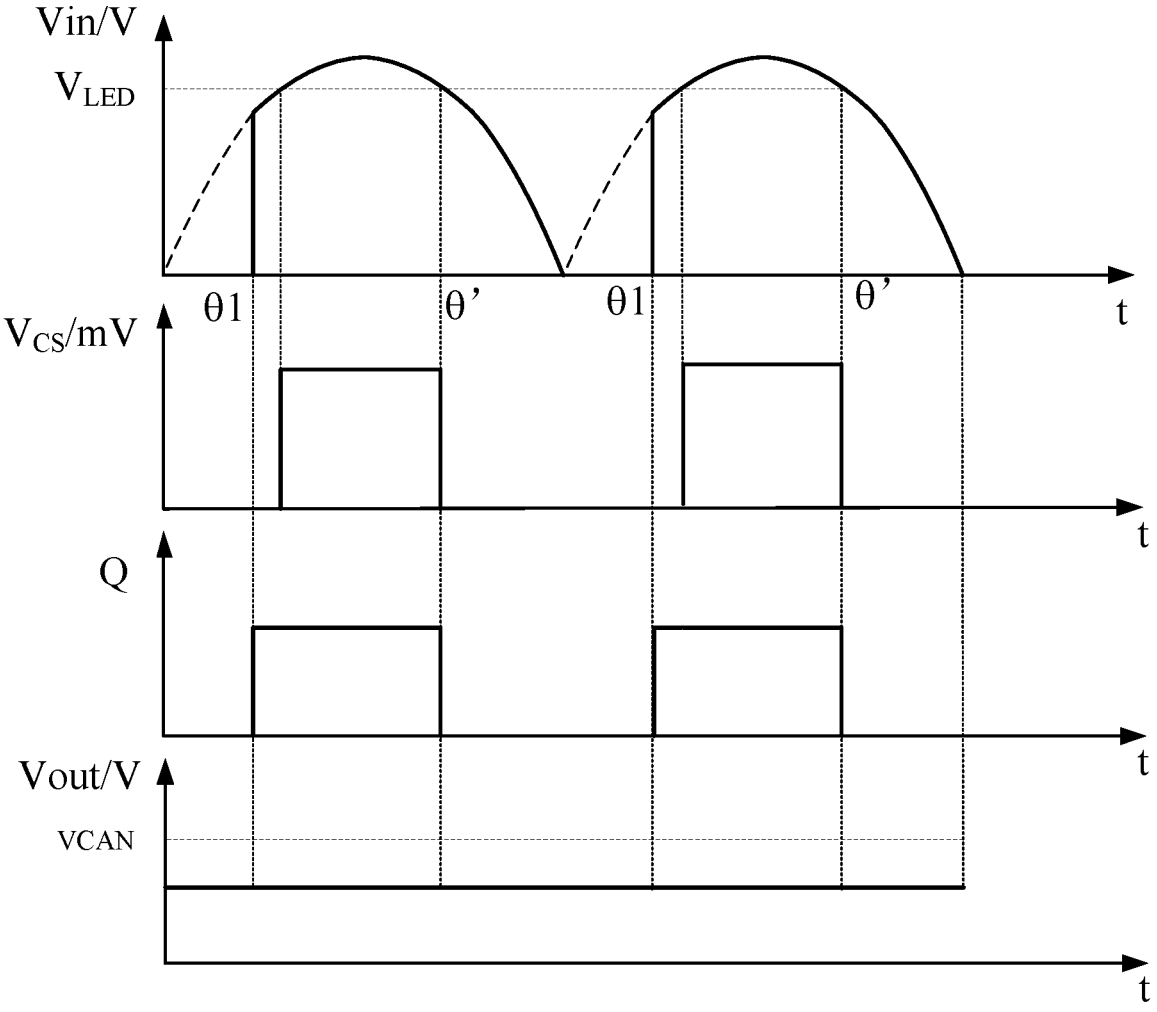
FIG. 18 is a schematic diagram illustrating an exemplary waveform for detecting an input voltage and a second electrical parameter signal according to some embodiments of the present disclosure.

FIG. 17 is a schematic diagram illustrating an exemplary circuit for detecting an input voltage and a second electrical parameter signal. As shown in FIG. 17, the thyristor chopping angle detection circuit 60 may include a second operational amplifier U2, a third operational amplifier U3, a first pulse generation circuit A1, a second pulse generation circuit A2, an RS trigger, and a sampling integral circuit 61. A non-inverting input terminal of the second operational amplifier U2 may receive an input voltage sampling signal Vdect, and an inverting input terminal of the second operational amplifier U2 may receive a sixth threshold for providing a starting threshold of a rising edge acquisition. An inverting input terminal of the third operational amplifier U3 may receive the second electrical parameter signal $V_{CS}$, and a non-inverting input terminal of the third operational amplifier U3 may receive a seventh threshold for providing an end threshold of a falling edge acquisition. Output terminals of the second operational amplifier U2 and the third operational amplifier U3 may be connected to input terminals of the first pulse generation circuit A1 and the second pulse generation circuit A2, respectively. Output terminals of the first pulse generation circuit A1 and the second pulse generation circuit A2 may be connected to an S terminal and an R terminal of the RS trigger, respectively. A pulse signal may be input to the RS trigger by a pulse circuit when a flip signal generated by an operational amplifier is detected. An output terminal of the RS trigger may be connected to the sampling integral circuit. And the sampling integral circuit may receive the reference voltage. Specifically, the second operational amplifier U2 may generate a first flip signal X1 when the input voltage Vin reaches a rising edge threshold. The first pulse generation circuit A1 may input a first pulse signal Y1 to the RS trigger when the first flip signal X1 is detected. Similarly, the third operational amplifier U3 may generate a second flip signal X2 when the second electrical parameter signal $V_{CS}$ reaches a falling edge threshold. And the second pulse generation circuit A2 may input a second pulse signal Y2 to the RS trigger when the second flip signal X2 is detected. According to the waveforms illustrated in FIG. 17 and FIG. 18, a Q terminal and a $\overline{Q}$ terminal of the RS trigger may be connected to the control terminals of the two switches in the sampling integral circuit 61, respectively. One terminal of the two switches arranged in series may receive the reference voltage, and the other terminal may be grounded. A common terminal of the two switches may be connected to an integral resistor. An integral capacitor may be provided between the integral resistor and the ground. The output terminal of the sampling integral circuit 61 may be connected to the bleeder current control circuit 70 for inputting the first current parameter signal Vout after an operation processing. As shown in FIG. 18, in the embodiment, the thyristor chopping angle detection circuit 60 may detect angles in a large range, and may detect an angle from the start of the thyristor conduction 81 to the turn-off of the second electrical parameter signal $V_{CS}$. At the same time, the input voltage Vin and the second electrical parameter signal $V_{CS}$ may be detected such that the accuracy of the detection angle may be improved, which may ensure the control stability of the subsequent bleeder circuit.

Figure 8:
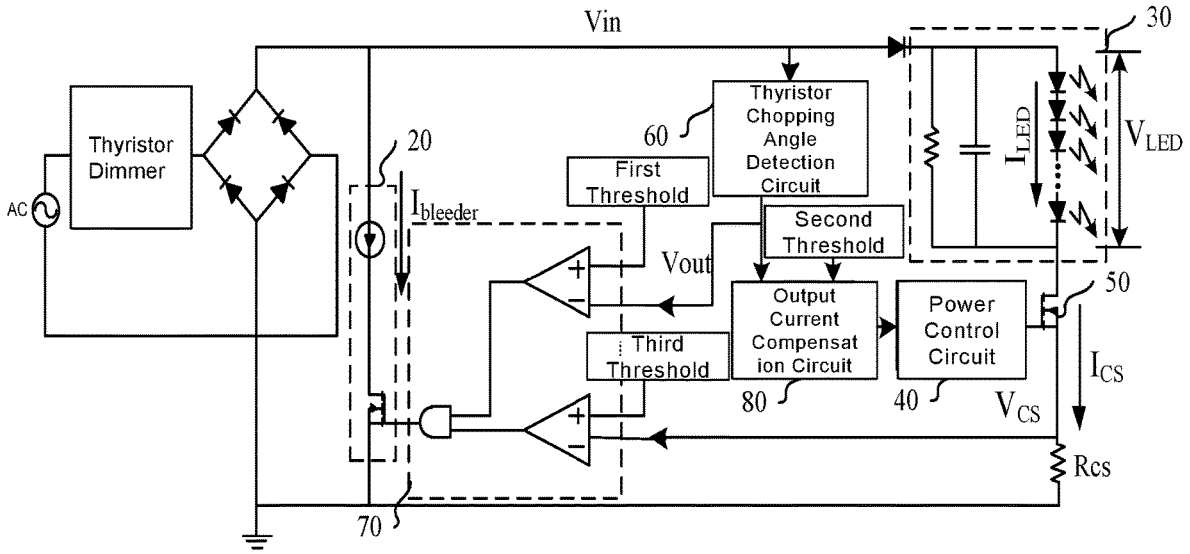
FIG. 8 is a schematic diagram illustrating an exemplary bleeder current control circuit for controlling a bleeder current according to some embodiments of the present disclosure.

FIG. 8 illustrates a bleeder current control circuit 70 that controls the bleeder current after the LED circuit 30 is conducted. It should be noted that, other forms or more complex circuits may also be employed. The bleeder current control circuit 70 may include a first comparison amplifier that compares the first threshold with the first electrical parameter signal, and a second comparison amplifier that compares the third threshold with the electrical parameter signal $V_{CS}$. The bleeder current control circuit 70 may further include a logic gate circuit (illustrated as an AND gate in figures) for controlling the bleeder current circuit 20 based on a comparison result of the first comparison amplifier and the second comparison amplifier. Output terminals of the two comparison amplifiers in the circuit may be connected to two input terminals of the AND gate. The first threshold may be input into a non-inverting input terminal of the first comparison amplifier, and an inverting input terminal may be configured to receive the electrical parameter signal Vou. The third threshold may be input into a non-inverting input terminal of the second comparator amplifier, and the electrical parameter signal $V_{CS}$ may be input into an inverting input terminal thereof. The AND gate may control a turn-off and a turn-on of the bleeder current circuit 20 based on voltage levels output by the two comparators.

When the electrical parameter signal Vout is larger than the first threshold, the initial conduction angle may be small, and the first comparison amplifier may output a low voltage level. At this time, the conduction of the bleeder current circuit 20 may be turned off by the AND gate to stop providing a bleeder current. When the electrical parameter signal Vout is less than the first threshold, the initial conduction angle may be large, and the first comparison amplifier may output a high voltage level, and when the electrical parameter signal $V_{CS}$ is larger than the third threshold, the second comparison amplifier may output a low voltage level. At this time, the conduction of the bleeder current circuit may be turned off by the AND gate to stop providing a bleeder current. When the electrical parameter signal Vout is less than the first threshold, the first comparison amplifier may output a high voltage level, and when the electrical parameter signal $V_{CS}$ is less than the third threshold, the second comparison amplifier may output a high voltage level. At this time, the conduction of the bleeder current circuit 20 may be turned on by the AND gate to provide a bleeder current.

Optionally, if the electrical parameter signal $V_{CS}$ received by the bleeder current control circuit 70 is less than the third threshold when the thyristor dimmer 10 is conducted, even if the electrical parameter signal Vout is larger than the first threshold, the bleeder current control circuit 70 may turn on the bleeder current circuit 20 to provide a bleeder current.

Optionally, an NMOS transistor used in the bleeder current circuit 20 may be a switching transistor such as an NPN/PNP, a PMOS, or the like.

In the dimmable LED drive circuit, after the electrical parameter signal Vout is output by the thyristor chopping angle detection circuit 60, when the electrical parameter signal Vout is larger than the first threshold, the bleeder current circuit 20 may be controlled to stop providing a bleeder current to improve the operating efficiency of the system. When the electrical parameter signal Vout is less than the first threshold and the electrical parameter signal $V_{CS}$ is less than the third threshold, the bleeder current circuit 20 may be controlled to provide a bleeder current again to ensure the stability of the system.

In an AC-powered dimmable LED drive circuit, when a peak voltage Vin_pk input by the thyristor dimmer 10 after chopping is close to an output LED lamp voltage $V_{LED}$ within a certain range ($Vin_pk-V_{LED}<\Delta V$, at this time the thyristor dimmer is at a small angle), the chopping of the thyristor dimmer 10 may have a serious asymmetry, which may cause a flash. If a difference between the peak voltage Vin_pk input by the thyristor dimmer 10 after chopping and the LED lamp voltage $V_{LED}$ is larger than or equal to the range (Vin_pk-$V_{LED}$ ΔV), the chopping of the thyristor dimmer 10 may not have the serious asymmetry, and the flash may not occur. Thus, the LED current may be reduced to zero or a low value when the difference between the peak voltage Vin_pk input by the thyristor dimmer 10 after chopping and the LED lamp voltage $V_{LED}$ is larger than or equal to the range (Vin_pk-$V_{LED}$ ΔV), so as to solve the flash problem. In some embodiments, the value of ΔV may be determined by a user input. The ΔV may be a fixed voltage value, and may also depend on the forward voltage $V_{LED}$ of the LED lamp (e.g., ΔV may be a fixed or variable ratio of $V_{LED}$).

In order to solve the problems abovementioned in the present disclosure, an output current compensation circuit 80 may be added between the thyristor chopping angle detection circuit 60 and the power control circuit 40. Moreover, the input terminal of the power control circuit 40 may be connected to an output terminal of the output current compensation circuit 80. The output terminal of the thyristor chopping angle detection circuit 60 may be connected to a first input terminal of the output current compensation circuit 80.

When the electrical parameter signal Vout output by the thyristor chopping angle detection circuit 60 is received by the output current compensation circuit 80, the electrical parameter signal Vout may be compared with a second threshold. When the electrical parameter signal Vout is less than the second threshold, which means a peak voltage input after the chopping may be close to the output LED lamp voltage $V_{LED}$ within a certain range, the output current compensation circuit 80 may control a current of the LED circuit 30 to gradually decrease. The smaller the electrical parameter signal Vout is, the larger the amplitude of the current in the LED circuit 30 may be adjusted by the output current compensation circuit 80. And until Vin_pk-$V_{LED}$ ΔV, a peak current of the LED circuit 30 may be reduced to zero by the output current compensation circuit, or may be reduced to a small value, at which point the flash problem may be resolved.

Preferably, an inverting input terminal of the power control circuit 40 may be connected to an output terminal of the output current compensation circuit 80, so that the power control circuit 40 may control a falling slope of a peak current of the $I_{CS}$.

Preferably, the second input terminal of the bleeder current control circuit 70 may be connected between the MOS transistor 50 and the sampling resistor $R_{CS}$, so as to cause the bleeder current control circuit 70 to detect the electrical parameter signal $V_{CS}$ in real time. When the electrical parameter signal $V_{CS}$ is less than the internally set third threshold, the bleeder current circuit 20 may supply a current to maintain the conduction of the thyristor dimmer 10.

An output current flowing through the sampling resistor $R_{CS}$ may be characterized by the $I_{CS}$ peak current, a current flowing through the LED circuit (30) may be characterized by the electrical parameter signal $V_{CS}$, and $V_{CS}=I_{CS}*R_{CS}$.

Figure 9A:
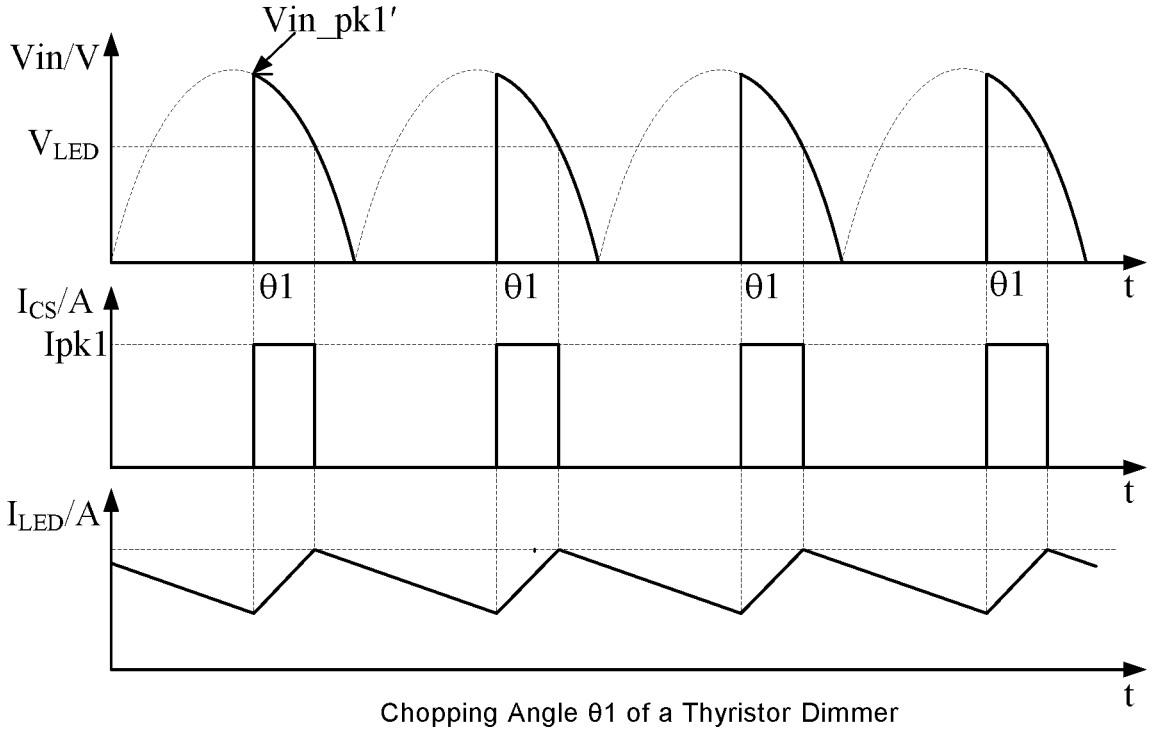
FIGS. 9A, 9B, and 9C are schematic diagrams illustrating three exemplary relationships between $I_{CS}$ currents, $I_{LED}$ currents, and thyristor dimmer chopping angles according to some embodiments of the present disclosure.
Figure 9B:
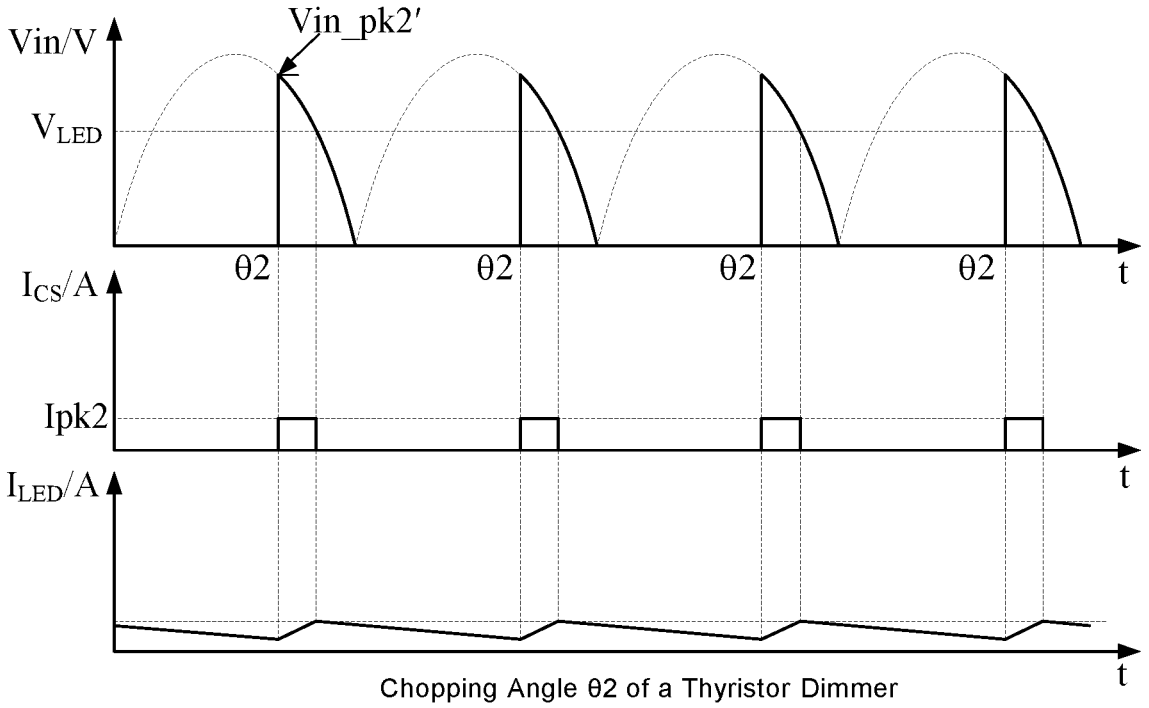
Figure 9C:
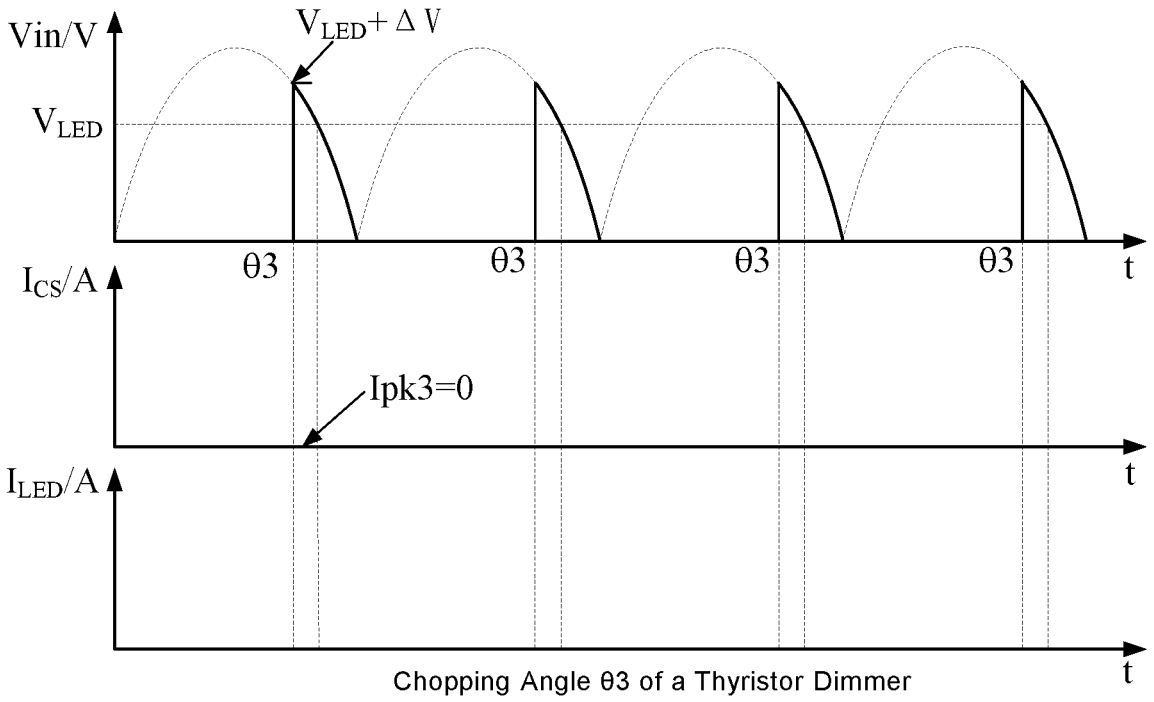

In some embodiments, different relationships between thyristor dimmer chopping angles, $I_{CS}$ currents and $I_{LED}$ currents may be illustrated in FIGS. 9A, 9B, and 9C. As shown in FIGS. 9A, 9B, and 9C, chopping angles 8 of the thyristor dimmer 10 may be θ1, θ2, and θ3, respectively, and the peak voltages input after the chopping may be Vin_pk1', Vin_pk2', and $V_{LED}$+ΔV, respectively. The chopping angles satisfy the condition θ1<θ2<θ3, and the peak voltages input after the chopping satisfy the condition Vin_pk1'>Vin_pk2'>$V_{LED}$+ΔV.

When the thyristor chopping angle detection circuit 60 detects that the chopping angle θ of the thyristor dimmer 10 reaches the 81 set corresponding to the second threshold (as shown in FIG. 9A, when the chopping angle θ is less than or equal to 81, the peak current of $I_{CS}$ may be Ipk1), the output current compensation circuit 80 may start to reduce the peak current of $I_{CS}$. And as the chopping angle θ of the thyristor dimmer 10 gradually increases, the peak current of the $I_{CS}$ may continue to decrease (as shown in FIG. 9B, the peak current of the $I_{CS}$ decreases to Ipk2, Ipk2<Ipk1). At this time, the current of the LED may decrease as the peak current of $I_{CS}$ decreases. When the thyristor chopping angle detection circuit 60 detects that the initial chopping angle θ of the thyristor dimmer 10 increases to θ3 (as shown in FIG. 9C, at the time when the peak voltage input by the thyristor dimmer 10 after chopping is $V_{LED}$+ΔV), the peak current of the $I_{CS}$ may be reduced to zero by the output current compensation circuit 80. If the peak current of the $I_{CS}$ decreases to zero before the input voltage Vin is larger than the LED forward voltage $V_{LED}$, the flash problem may be solved. If the peak current of the $I_{CS}$ decreases to a small value after the input voltage Vin is less than the LED forward voltage $V_{LED}$, the small-angle flash may be greatly solved.

Figure 10:
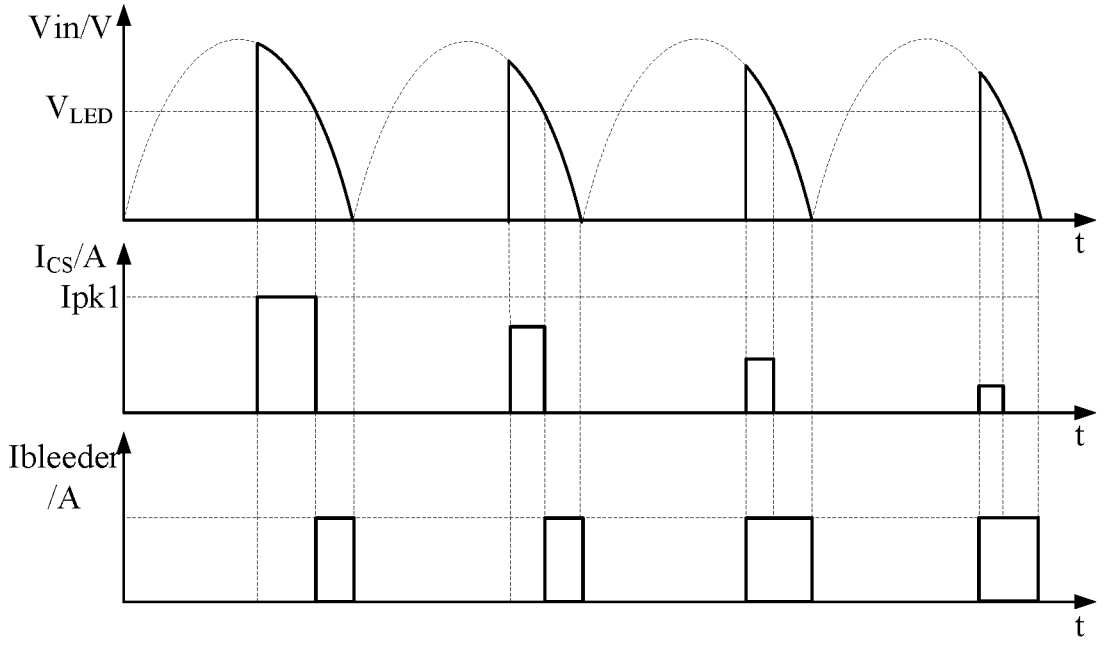
FIG. 10 is a schematic diagram illustrating an exemplary bleeder current when a peak current of the $I_{CS}$ is reduced by the thyristor chopping angle detection circuit according to some embodiments of the present disclosure.
Figure 11:
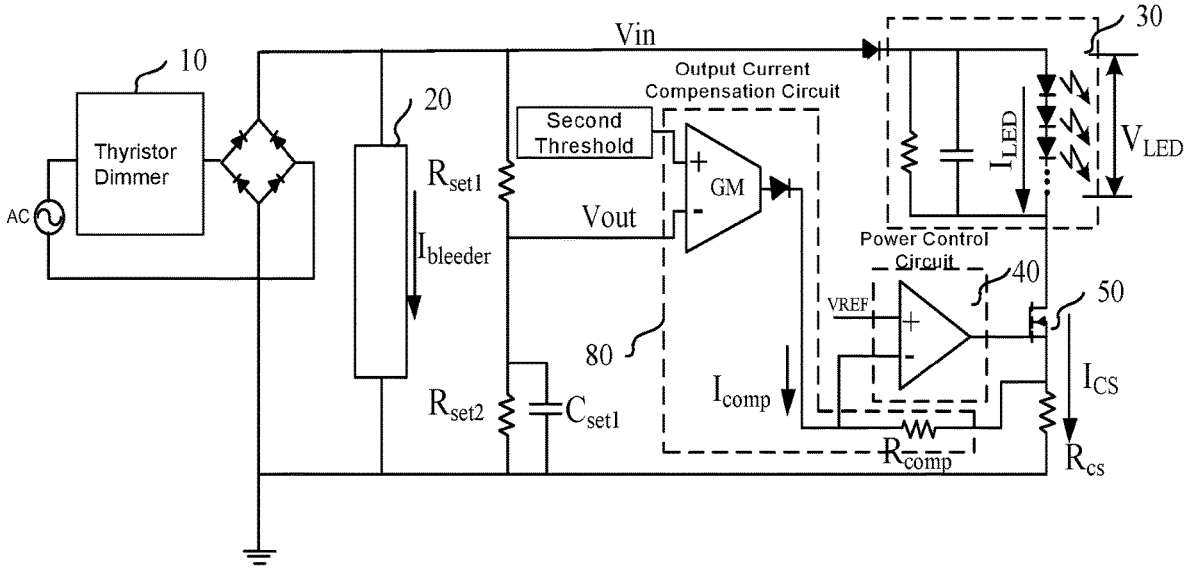
FIG. 11 is a schematic diagram illustrating an exemplary output current compensation circuit for solving a flash problem according to some embodiments of the present disclosure.

In some embodiments, FIG. 10 illustrates a corresponding bleeder current when the peak current of the $I_{CS}$ is reduced by the thyristor chopping angle detection circuit 60. When the peak current of the $I_{CS}$ starts to gradually decrease, the electrical parameter signal $V_{CS}$ may be detected by the bleeder current control circuit 70 in real time. When the electrical parameter signal $V_{CS}$ is less than the third threshold, the bleeder current circuit 20 may supply a current to maintain the conduction of the thyristor dimmer 10.

In some embodiments, to solve the flash problem, an output current compensation circuit 80 is provided in the present disclosure. The output current compensation circuit 80 may include a first transconductance amplifier GM and a compensation resistor Rcomp. In the output current compensation circuit 80, an output terminal of the first transconductance amplifier may be connected to a drain of the MOS transistor through a one-way diode and the compensation resistor Rcomp. The second threshold may be input to a non-inverting input terminal, and an inverting input terminal may be coupled to receive the electrical parameter signal Vout generated by the thyristor chopping angle detection circuit 60.

The output current compensation circuit 80 may detect a voltage value of the electrical parameter signal Vout input to the inverting input terminal of the first transconductance amplifier. If the voltage value of the electrical parameter signal Vout decreases to the second threshold, the output terminal of the first transconductance amplifier may start to output a compensation current Icomp, which may generate a compensation voltage Vcomp (Vcomp=Icomp×Rcomp) on the compensation resistor Rcomp, thereby reducing the peak current of the $I_{CS}$. If the electrical parameter signal Vout continues to decrease, the compensation current Icomp may gradually increase, the peak current of the $I_{CS}$ may gradually decrease, and the LED current may gradually decrease. If the electrical parameter signal Vout decreases to a certain value (i.e., the chopping angle is θ3, and the peak voltage input by the thyristor dimmer 10 after chopping is $V_{LED}$+ΔV as shown in FIG. 9C), and the compensation voltage Vcomp increases to be equal to $V_{REF}$ in the power control circuit 40, the peak current of the $I_{CS}$ may decrease to zero, and the current on the LED circuit 30 may also decrease to zero, such that the LED current may decrease to zero before the thyristor dimmer 10 is severely asymmetrical, thus solving the flash problem.

Figure 12:
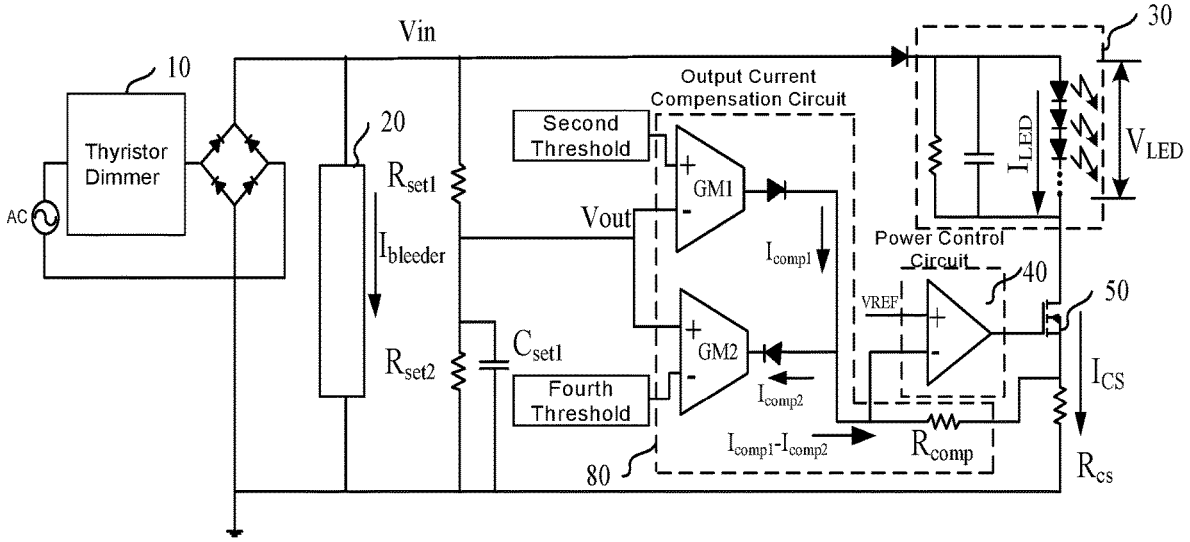
FIG. 12 is a schematic diagram illustrating an exemplary output current compensation circuit for improving a small angle flash according to some embodiments of the present disclosure.

In some embodiments, to improve the small-angle flash problem, as shown in FIG. 12, another output current compensation circuit 80 is provided in the present disclosure. The output current compensation circuit 80 may include a first transconductance amplifier, a second transconductance amplifier, and a compensation resistor Rcomp. A second threshold may be input to a non-inverting input terminal of the first transconductance amplifier. An inverting input terminal may be connected to a non-inverting input terminal of the second transconductance amplifier to receive the electrical parameter signal Vout. A fourth threshold value may be input to an inverting input terminal of the second transconductance amplifier. An output terminal of the first transconductance amplifier GM1 with a one-way (an output direction) diode, an output terminal of the second transconductance amplifier GM2 with another one-way (an input direction) diode in an opposite direction, may be coupled together and then coupled to the drain of the MOS transistor 50 via the compensation resistor Rcomp. Additionally, the second threshold may be larger than the fourth threshold. When the electrical parameter signal Vout decreases to the fourth threshold, an output current of the first transconductance amplifier may be limited by the second transconductance amplifier. As a result, the $I_{CS}$ may be limited to a small value, thereby achieving a large improvement to the small-angle flash problem.

Optionally, the first threshold, the second threshold, the third threshold, and the fourth threshold abovementioned may be any one of a current threshold, a voltage threshold, a time threshold, or the like.

Figure 13:
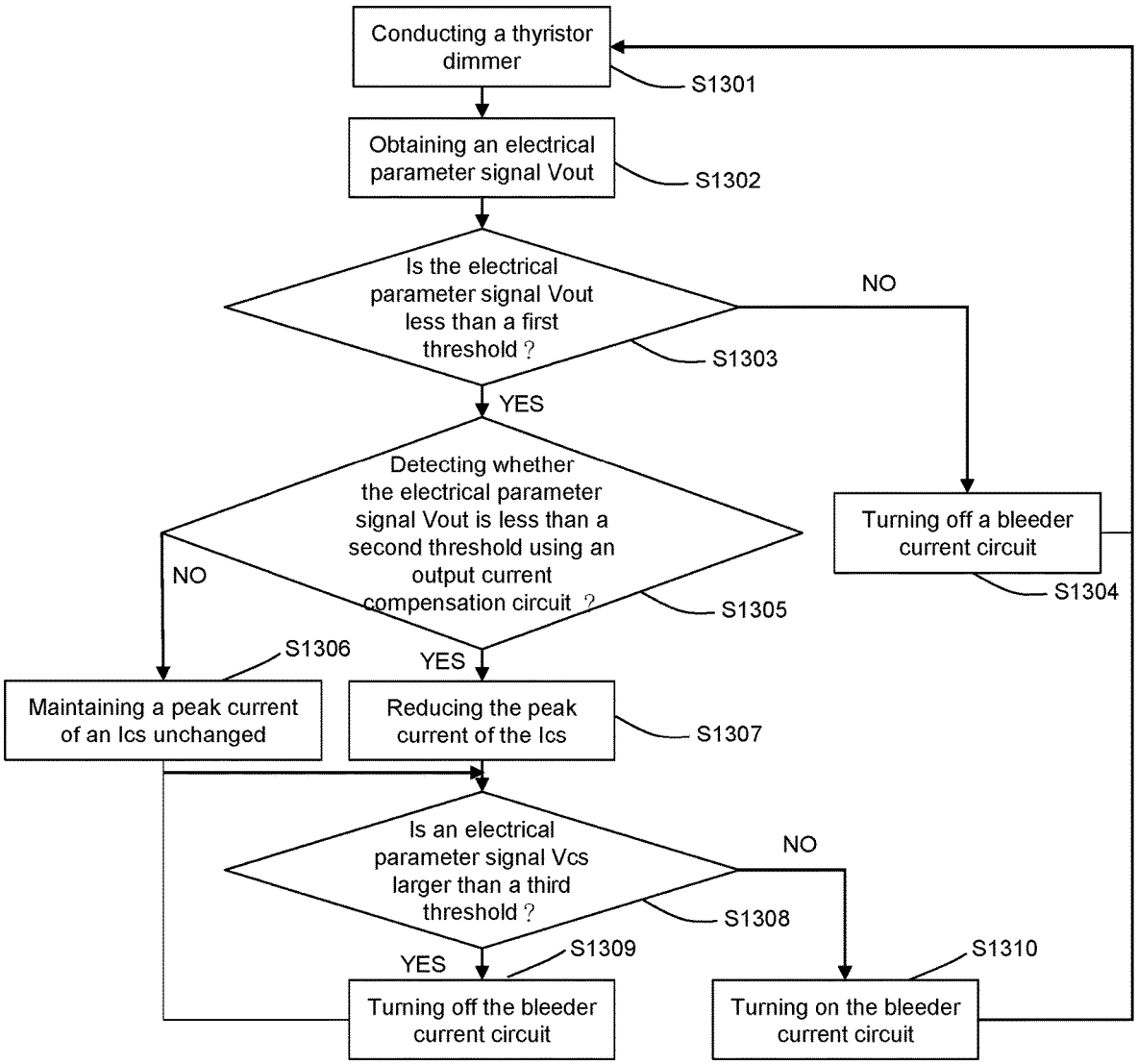
FIG. 13 is a flow chart illustrating a control method of a bleeder current according to some embodiments of the present disclosure.

FIG. 13 is a flow chart illustrating a control method according to some embodiments of the present disclosure. As shown in FIG. 13, a control method is provided in the present disclosure. The control method may include:

S1301, conducting a thyristor dimmer.

S1302, obtaining an electrical parameter signal Vout. The electrical parameter signal Vout may correspond to an average value of the input voltage Vin from the initial conduction chopping angle of the thyristor dimmer 10 to the end of a cycle. The input voltage Vin may be a full-wave rectified voltage obtained by a rectifier bridge rectifying an alternating current flowing through the thyristor dimmer 10. The input voltage Vin may be a driving voltage of the LED circuit.

S1303, comparing the electrical parameter signal Vout with the first threshold using the bleeder current control circuit 70 to control the bleeder current circuit 20. When the electrical parameter signal Vout is larger than the first threshold, operation S1304 may be performed. When the electrical parameter signal Vout is less than the first threshold, operation S1305 may be performed.

Merely by way of example, the first threshold value may correspond to an average value of the input voltage Vin during a period from a first initial conduction chopping angle to the end of a cycle in which the thyristor dimmer 10 has the first initial conduction chopping angle. A sum of a power loss of the linear LED drive and a circuit loss of the bleeder current circuit 20 without adjusting an output current in the cycle in which the thyristor dimmer 10 has the first initial chopping angle may be equivalent to a sum of a power loss of the linear LED drive and a circuit loss of the bleeder current circuit before the input voltage Vin reaches the forward voltage of the LED circuit 30 in a cycle with a minimum initial chopping angle.

S1304, turning off the conduction of the bleeder current circuit 20 using the bleeder current control circuit 70 to stop providing the bleeder current. Further, operation S1301 may be performed.

S1305, detecting whether the electrical parameter signal Vout is less than the second threshold using the output current compensation circuit 80.

S1306, maintaining a peak current of an output current unchanged using the output current compensation circuit 80 when an input voltage Vout is larger than the second threshold. Further, operation S1308 may be performed.

S1307, reducing the peak current of the output current using the output current compensation circuit 80 when an input voltage Vout is less than the second threshold. Further, operation S1308 may be performed.

S1308, detecting the electrical parameter $V_{CS}$ and determining whether the electrical parameter $V_{CS}$ is less than the third threshold using the bleeder current control circuit 70. The electrical parameter $V_{CS}$ may correspond to a current flowing through the LED circuit (30).

S1309, turning on the conduction of the bleeder current circuit 20 using the bleeder current control circuit 70 to provide a bleeder current when the electrical parameter $V_{CS}$ is less than the third threshold. Further, operation S1308 may be performed.

S1310, turning off the conduction of the bleeder current circuit 20 using the bleeder current control circuit 70 to stop providing a bleeder current when the electrical parameter $V_{CS}$ is larger than the third threshold. Further, operation S1301 may be performed.

In operation S1303, the electrical parameter signal Vout may be compared with the first threshold. In other words, the initial conduction angle θ of the thyristor dimmer 10 may be compared with a conduction angle θth determined by the first threshold.

Preferably, in operation S1304, when the initial conduction angle θ of the thyristor dimmer 10 is less than the conduction angle θth determined by the first threshold, a small bleeder current may be provided by the bleeder current circuit 20.

Preferably, in operation S1304, when the initial conduction angle θ of the thyristor dimmer 10 is less than the conduction angle θth determined by the first threshold, the bleeder current may be turned off first, and then the bleeder current circuit 20 may be turned on after 1 ms to provide a small bleeder current.

In the present disclosure, efficiency and stability of the linear thyristor LED drive circuit may be improved by controlling the turn-on and turn-off of the bleeder current. At the same time, the problem of small-angle flash problem of the thyristor dimmer may be solved.

It should be noted that in the present disclosure, relationship terms such as first and second are used merely to distinguish one entity or operation from another entity or operation, and do not necessarily require or imply any such actual relationship or order between the entities or operations. Furthermore, the terms "include", "comprise" or "comprising" or any other variants are intended to encompass a non-exclusive inclusion, such that a process, method, item, or device that comprises a plurality of elements includes not only those elements but also other elements that are not explicitly listed, or elements that are inherent to such a process, method, item, or device. An element defined by the phrase "comprising a . . . " without further limitation does not exclude the existence of additional identical elements in the process, method, item or device that comprises the element.

The specific embodiments described above further explain the purpose, technical solutions and beneficial effects of the present disclosure. It should be understood that the above description is only for the specific embodiments of the present disclosure, and is not intended to limit the scope of protection of the present disclosure. Any modifications, equivalent substitutions, improvements, etc. made within the spirit and principles of the present disclosure shall be covered by the scope of the present disclosure.

What is claimed is:

1. A dimmable LED drive circuit, comprising:

an LED circuit configured to emit light;

a thyristor dimmer configured to control a voltage waveform applied to the LED circuit, the voltage waveform including a chopping angle corresponding to an initial conduction of the thyristor dimmer;

a bleeder current circuit configured to provide a current path for the thyristor dimmer to maintain a conduction of the thyristor dimmer;

a thyristor chopping angle detection circuit configured to detect at least one parameter associated with the chopping angle of the voltage waveform applied to the LED circuit;

a bleeder current control circuit configured to control an operation of the bleeder current circuit based on an operation of the LED circuit and the at least one parameter associated with the chopping angle; and an output current compensation circuit configured to reduce a current flowing through the LED circuit when a voltage corresponding to the chopping angle is close to a forward voltage of the LED circuit.

2. The dimmable LED drive circuit of claim 1, wherein the at least one parameter associated with the chopping angle of the voltage waveform includes an average value of voltages applied to the LED circuit during a cycle of the voltage waveform.

3. The dimmable LED drive circuit of claim 1, wherein the bleeder current control circuit controls the operation of the bleeder current circuit based on a comparison between a value of the at least one parameter associated with the chopping angle of the voltage waveform and a first threshold.

4. The dimmable LED drive circuit of claim 1, wherein the bleeder current control circuit turns off the bleeder current circuit when the LED circuit is in a non-conducting state and the chopping angle is less than an angle threshold.

5. The dimmable LED drive circuit of claim 1, wherein the current flowing through the LED circuit is closer to zero with the voltage corresponding to the chopping angle being closer to the forward voltage of the LED circuit.

6. The dimmable LED drive circuit of claim 1, wherein that the voltage corresponding to the chopping angle is close to the forward voltage of the LED circuit includes that a value of the at least one parameter associated with the chopping angle of the voltage waveform is less than a second threshold.

7. The dimmable LED drive circuit of claim 1, wherein the bleeder current control circuit is configured to turn on the bleeder current circuit before a current flowing through the LED circuit decreases to zero.

8. The dimmable LED drive circuit of claim 7, wherein the bleeder current control circuit is configured to:

determine a parameter associated with the current flowing through the LED circuit; and turn on the bleeder current circuit in response to a determination that a value of the parameter associated with the current flowing through the LED circuit is less than a third threshold.

9. A dimmable LED drive circuit, comprising:

an LED circuit configured to emit light;

a thyristor dimmer configured to control a voltage waveform applied to the LED circuit, the voltage waveform including a chopping angle corresponding to an initial conduction of the thyristor dimmer;

an output current compensation circuit configured to adjust a current flowing through the LED circuit when a voltage corresponding to the chopping angle is close to a forward voltage of the LED circuit.

10. The dimmable LED drive circuit of claim 9, wherein the output current compensation circuit adjusts the current flowing through the LED circuit to be closer to zero with the voltage corresponding to the chopping angle being closer to the forward voltage of the LED circuit.

11. The dimmable LED drive circuit of claim 9, further comprising:

a thyristor chopping angle detection circuit configured to detect at least one parameter associated with the chopping angle of the voltage waveform applied to the LED circuit.

12. The dimmable LED drive circuit of claim 11, wherein that the voltage corresponding to the chopping angle is close to the forward voltage of the LED circuit includes that a value of the at least one parameter associated with the chopping angle of the voltage waveform is less than a threshold.

13. The dimmable LED drive circuit of claim 11, further comprising:

a bleeder current circuit configured to provide a current path for the thyristor dimmer to maintain a conduction of the thyristor dimmer; and a bleeder current control circuit configured to control an operation of the bleeder current circuit based on an operation of the LED circuit and the at least one parameter associated with the chopping angle.

14. The dimmable LED drive circuit of claim 13, wherein the bleeder current control circuit turns off the bleeder current circuit when the LED circuit is in a non-conducting state and the chopping angle is less than an angle threshold.

15. A dimmable LED drive circuit, comprising:

an LED circuit configured to emit light;

a thyristor dimmer configured to control a voltage waveform applied to the LED circuit, wherein during at least one cycle of the voltage waveform, the LED circuit changes from a conducting state to a non-conducting state such that a current flowing through the LED changes from a non-zero value to zero, and the voltage waveform includes a chopping angle corresponding to an initial conduction of the thyristor dimmer;

a bleeder current circuit configured to provide a current path for the thyristor dimmer to maintain a conduction of the thyristor dimmer, a bleeder current control circuit configured to control an operation of the bleeder current circuit based on an operation of the LED circuit, wherein the bleeder current control circuit turns on the bleeder current circuit before a current flowing through the LED circuit decreases to zero during the at least one cycle of the voltage waveform; and an output current compensation circuit configured to reduce, during the at least one cycle of the voltage waveform, the current flowing through the LED circuit when a voltage corresponding to the chopping angle is close to a forward voltage of the LED circuit.

16. The dimmable LED drive circuit of claim 15, wherein the bleeder current control circuit is configured to:

determine a parameter associated with the current flowing through the LED circuit; and turn on the bleeder current circuit in response to a determination that a value of the parameter associated with the current flowing through the LED circuit is less than a third threshold.

17. The dimmable LED drive circuit of claim 15, wherein the current flowing through the LED circuit is closer to zero with the voltage corresponding to the chopping angle being closer to the forward voltage of the LED circuit.

18. The dimmable LED drive circuit of claim 15, wherein the bleeder current control circuit turns off the bleeder current circuit when the LED circuit is in the non-conducting state and the chopping angle is less than an angle threshold.

* * * * *